US006273994B1

(12) United States Patent
Creber et al.

(10) Patent No.: US 6,273,994 B1
(45) **Date of Patent: *Aug. 14, 2001**

(54) METHOD AND DEVICE FOR MEASURING BLEACH REQUIREMENT, BLEACHABILITY, AND EFFECTIVENSS OF HEMICELLULASE ENZYME TREATMENT OF PULP

(75) Inventors: Brian Creber, Dunrobin; Brian Foody, Ottawa; Patrick J. Foody, Ottawa; Jeffrey S. Tolan, Ottawa, all of (CA)

(73) Assignee: Iogen Corporation, Ottawa (CA)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/016,425

(22) Filed: Jan. 30, 1998

(51) Int. Cl.[7] ..... D21C 7/14

(52) U.S. Cl. ..... 162/49; 162/80; 162/81; 162/82; 162/87; 162/238; 162/252; 162/263; 162/DIG. 10

(58) Field of Search ..... 162/49, 198, 82, 162/263, 262, 252, DIG. 10, 80, 81, 87, 238

(56) References Cited

U.S. PATENT DOCUMENTS

| | | | | |
|---|---|---|---|---|
| 1,827,658 | * | 10/1931 | Johnsen | 162/49 |
| 3,436,302 | * | 4/1969 | Goodwald et al. | 162/82 |
| 3,764,463 | * | 10/1973 | Histed et al. | 162/49 |
| 3,781,188 | * | 12/1973 | Bagley et al. | 162/49 |
| 3,968,006 | * | 7/1976 | Zimmerman | 162/198 |
| 4,013,506 | | 3/1977 | Histed et al. | 162/49 |
| 4,192,708 | | 3/1980 | Bergstrom et al. | 162/49 |
| 4,193,840 | * | 3/1980 | Andrews et el. | 162/49 |
| 4,837,446 | * | 6/1989 | Renard et al. | 250/461.1 |
| 4,952,276 | | 8/1990 | Gidlund et al. | 162/49 |
| 5,154,087 | * | 10/1992 | Wenshau et al. | 73/863.85 |
| 5,536,942 | * | 7/1996 | Barringer et al. | 250/339.12 |
| 5,611,891 | * | 3/1997 | Hundley, III | 162/198 |
| 5,735,004 | * | 4/1998 | Pangalos et al. | 162/49 |
| 5,842,150 | | 11/1998 | Renberg et al. | 702/23 |

FOREIGN PATENT DOCUMENTS

| | | |
|---|---|---|
| 2079000 | of 1996 | (CA) . |
| 0226 113A | 6/1987 | (EP) . |
| 6-269297 | 9/1994 | (JP) . |
| WO 96/12183 | 4/1996 | (WO) . |

OTHER PUBLICATIONS

Calkin, Modern Pulp and Paper Making, Reinhold Pub. Co., 1957.*

Lewis, Hawley's Condensed Chemical Dictionary, John Wiley and Sons INC., 1997.*

S. Rydholm., "Pulping Processes", (1963).

Dence et al., "Pulp Bleaching: Principles and Practice", pp. 249,315,385,609, (1996).

G.A. Smook., "Handbook for Pulp & Paper Technologists", p. 390, (1989).

Tappi Method T236–cm85, "Kappa Number of Pulp", (1984).

*Tappi Method T253–om86*, "Hypo Number of Pulp", (1986).

Tappi Method T452–om92, "Brightness of Pulp, Paper, and Paperboard (Directional Reflectance at 457 nm)," (1992).

Yee et al., "Enzyme Treatment", *Pulp & Paper Canada*, p. 42–45,48–49, (1997).

Tolan et al., *CPPA Bleaching Course Notes*," Using Enzymes in Pulp Bleaching", (1983).

"Automatic Pulp Analyzers, Series SX4400", *Systematix Controls Incorporated*, (1994).

"KTSI Titration System for Automatic KAPPA/K Number Determination", Radiometer America Inc., (undated).

"BT–5000 Brightness Transmitter", *Operations Manual*, BTG Ltd. (1991).

300 Series Pulpstar, "Bleach Flow Control Signal Sources Based on Brightness and Chemical Residual", in Line Sensors Inc., (1992).

Freiermuth et al., "Assay Method and Device", Pat. Appln. No. 2,146,207, (1995).

"Polarox–C Residual Measurement Probe", *Kajaani Automation*, (undated).

"Alkaline Papermaking with Secondary Fiber 107", Brinecell Model 101, *Tappi Journal*, (1991).

"Kajaani Kappa Analyzer", *Measurements*, Valmet Automation, (undated).

"Kajaani Kappa Analyzer: Principles & Applications", Kajaani Electronics Ltd., (1994).

"Kajaani Kappa Analyzer: Delivery Limits", Kajanni Electronics Ltd., (1994).

"STFI OPTI–Kappa Documented Results", *ABB Process Automation*, ABB (undated).

Herngren et al., "New Fileber–Line Control Concept Improves Mill Performance", *Tappi Journal*, p. 77–79, (1991).

"ABB Smart Pulping: Smart Pulp Platform", *ABB Process Automation*, ABB, (undated).

*"ABB Master: AutoBleach Chlorine Bleaching Control", ABB Process Automation*, (1993).

(List continued on next page.)

*Primary Examiner*—Peter Chin
(74) *Attorney, Agent, or Firm*—Fitzpatrick, Cella, Harper & Scinto

(57) ABSTRACT

The present invention relates to a device and method for measuring the bleach requirement and bleachability of pulp in a pulp mill. The invention enables pulp mill operators to better control bleach plants. In one aspect, the invention comprises a system and method for rapid bleaching of the pulp, and measuring the rapid bleached brightness and lignin content of the pulp. In another aspect, the invention comprises an optical system for use in practicing embodiments of this invention.

28 Claims, 16 Drawing Sheets

OTHER PUBLICATIONS

Edlund et al., "Experiences From the STFI OPTI–Kappa and its Use for the Control of Pulping Processes", *Pulp & Paper Canada*, 93:12, p. 356–360, (1992).

Kubulnieks et al., "The STFI OPTI–Kappa Analyzer: Applications and Accuracy", *Tappi Journal*, p. 38–42, (1987).

BTG Kappa Number Analyzer, KNA–5100,BTG, (1995).

EG&G Emitters and Detectors, *Short Form Catalog*, EG&G Optoelectronics, (undated).

HG–XE Arc Lamp, *OSRAM–Sylvania*, (1994).

"Building America—Eye on Business", Fiberguide Industries, Inc., www.fiberguide.com, (1993).

"GE Fanuc Logic Controller", GE Fanuc Automation, www.ge.com, (1998).

Mark IV Laboratory Mixer/Reactor, *Quantum Chemical Company*, (undated).

* cited by examiner

METHOD AND DEVICE FOR MEASURING BLEACH REQUIREMENT, BLEACHABILITY, AND EFFECTIVENSS OF HEMICELLULASE ENZYME TREATMENT OF PULP

BACKGROUND OF THE INVENTION

1. Field of the Invention

The present invention relates to a method and a device for measuring the bleach requirement, bleachability, and effectiveness of hemicellulase enzyme treatment of pulp, and in particular, to a method and a device for rapidly making these measurements to enable pulp mill operators to determine more accurately the amount of bleaching chemicals required to bleach the pulp. The present invention also includes an optical device for use in the device.

2. Background of the Invention

Paper is made from wood and nonwood fibers. Wood is the predominant fiber source for paper in North America and Europe while straw predominates in Asia. The paper manufacturing processes based on wood and nonwood fibers are similar. The processes described below are for paper made from wood but can be directly related to paper made from nonwood fibers. This description is found in more detail in "Pulping Processes" by S. Rydholm, 1965.

The fibers used to make paper consist primarily of cellulose, hemicellulose, and lignin. The amounts of these three constituents present in the final paper product depends on the manufacturing process used. Pulp made from virgin fiber can be described in terms of the three primary classes of pulping processes: mechanical, semichemical, and chemical. Recycled pulp, also known as secondary fiber, consists of a combination of one or more of the three classes of pulp made from virgin fiber.

In mechanical pulping, the wood is broken up into a mat of pulp fibers by mechanical action, such as grinding with stones or blades or passing the pulp through refiners. When high temperatures are used to aid in the mechanical pulping, the process is known as thermomechanical pulping. Mechanical pulp has almost all of the original cellulose, hemicellulose, and lignin present and is used for lower-grade, disposable papers such as newsprint.

Paper made from mechanical pulp often must be of at least a minimum degree of whiteness to satisfy the end use. The degree of whiteness is known as the brightness of the pulp and is generally measured in terms of ISO brightness. One of ordinary skill in the art will recognize that there are various methods for measuring ISO brightness, such as TAPPI method T452. Mechanical pulp is sometimes bleached with perhaps 5 Kg/t hydrogen peroxide and/or 2 Kg/t sodium hydrosulfite to increase its brightness, although seldom to brightness levels obtained with other pulping methods. The bleaching chemicals are typically added in one operation for the hydrogen peroxide and a second operation for the sodium hydrosulphite. These bleaching operations are called stages.

Semichemical pulping refers to the combination of mechanical action and chemicals used to make pulp. The mechanical action is similar to that used in mechanical pulp. The chemicals added are typically neutral salts such as sodium sulphate. The presence of the salts aids in the pulping process and thereby decreases the intensity of mechanical action required. This decreases the damage to the fibers and results in pulp of higher strength than mechanical pulp. Semichemical pulps are used for products where some degree of strength is required, such as packaging. Like mechanical pulp, semichemical pulps retain almost all of the initial cellulose, hemicellulose, and lignin.

Semichemical pulps are sometimes bleached to improve their brightness. As with mechanical pulps, the most important bleaching chemicals are hydrogen peroxide and sodium hydrosulfite. The amount of these chemicals used is often 5-fold greater than with mechanical pulps, as a higher brightness is often desired. The bleaching of semichemical pulp is carried out typically with two or three hydrogen peroxide stages and then a sodium hydrosulfite stage.

The highest quality paper is made by chemical pulping processes. The manufacture of high quality, bright white paper largely depends on removing the lignin from the wood pulp with minimal degradation to the cellulose and hemicellulose. Complete lignin removal is essential for the production of fine paper, because lignin weakens and imparts color onto the pulp. The two principle chemical pulping processes are sulfite pulping, in which the pulping liquor is acidic sodium sulfite, and Kraft pulping, in which the cooking liquor is alkaline sodium sulfide. Kraft pulping is the more common process, with about 37 million tonnes of Kraft pulp and 3 million tonnes of sulfite pulp produced annually in North America.

In chemical pulping, 80% to 95% of the lignin is removed from the wood by cooking it in the chemical liquor in a batch reactor or a tall flow through tower, either of which is known as a "digester." After being washed with water, the cooked material contains 1.5% to 5% residual lignin and is known as brownstock. In some mills, almost half of the residual lignin is removed using an oxygen delignification reactor. Regardless of whether a mill carries out oxygen delignification or not, the remaining lignin is removed by a multi-stage bleaching process to obtain a bright, stable final product.

A general reference for bleaching pulp is "Pulp Bleaching: Principles and Practice" edited by D. Reeve and C. Dence, 1996 (hereafter "Reeve and Dence").

The first stage of a conventional bleaching process involves treating the brownstock with chlorine or chlorine dioxide or a mixture thereof. This is known as the "first stage" or the "chlorination stage", and the terms are used interchangeably herein. The chlorination stage is the most important bleaching stage, as 50% to 80% of the total bleaching chemicals are used in this stage.

In the second bleaching stage, the pulp is extracted with sodium hydroxide. This is known as the "second stage" or the "extraction stage", and the terms are used interchangeably herein. The chlorination and extraction stages reduce the lignin concentration in the pulp to less than 1%. The pulp requires 1 to 4 hours to pass through these two stages.

After extraction, the final lignin remaining in the pulp is removed in three additional stages. The "third" or "D1" stage consists of treating the pulp with chlorine dioxide. The "fourth" or "E2" stage is an extraction with sodium hydroxide. The "fifth" or "D2" stage is another chlorine dioxide stage. The final product of the D2 stage is the desired bright white pulp. Typically, 5 to 8 hours are required for the final three stages, and therefore 6 to 12 hours is required for pulp to pass through the bleach plant.

Secondary fiber can consist of paper made from mechanical, semichemical, or chemical pulping processes, or a mixture of paper made by any two or all three of these processes. The secondary fiber is repulped by processes analogous to, but milder than, the mechanical, semichemical, and chemical pulping processes used for virgin fiber. The secondary pulp is then bleached with hydrogen peroxide, sodium hydrosulfite, or chlorine-based oxidizing chemicals as is done with virgin pulps. A somewhat lesser amount of bleaching chemicals are required for bleaching secondary fiber than virgin fiber.

Whether the pulp consists of virgin or secondary fiber, and whether it is from a wood or nonwood fiber source, the most important specification for the bleached pulp is its brightness. The pulp customer specifies the minimum brightness that they can or will tolerate in their use of the pulp. Pulp that fails to achieve the minimum brightness, i.e. pulp that is underbleached, is known as "off-grade" pulp. This must be repulped and run through the bleach plant a second time, at great expense and loss of production time. Pulp whose brightness greatly exceeds the minimum for the customer is acceptable for sale, but the excess brightness is achieved at a cost of additional bleaching chemicals that is, in effect, wasted. This pulp is overbleached.

Pulp mill operators therefore balance between using a sufficient amount of bleaching chemicals to avoid off-grade pulp, but not overbleaching at large cost and waste of bleaching chemicals. Several methods and instruments have evolved to help the operators control the bleaching of the pulp. These are described in detail by Reeve and Dence.

The most common measurement used to estimate the amount of bleaching chemicals that should be added to the pulp is the brownstock Kappa number (hereafter "Kappa number"). The Kappa number is a measure of the amount of lignin in the pulp and therefore is related to the bleach requirement. Almost all bleached chemical pulp mills measure the Kappa number of the pulp entering the bleach plant.

The Kappa number is measured manually, semi-manually, or automatically. For manual measurement, a sample of pulp is oxidized by potassium permanganate, as described in TAPPI method T 236. This test is carried out by a technician and requires about 45 minutes to complete, including a separate step of drying and weighing pulp. The advantage of the manual test is that it does not require complex or expensive equipment. The disadvantage is the long time required and the variability in technique among technicians.

In a semi-manual determination, the technician prepares the weighed amount of dry pulp and places it in an instrument, which automatically adds the potassium permanganate and carries out the titrations required in TAPPI T 236. The instrument determines the Kappa number based on a titration, which is controlled by a spectrophotometer. Two commercial units of this semi-manual type are the Series SX 4400 Automatic Pulp Analyzers, from Systematix Controls Incorporated, Seattle, Wash., and KTS1 Titration System, from Radiometer America, Westlake, Ohio. The semi-manual method overcomes much of the variability associated with technicians, but is only slightly more rapid than the manual method.

Alternatively, the Kappa number is measured automatically by a Kappa number analyzer, several of which are commercially available.

The Kajaani Kappa Analyzer uses samples of pulp taken manually or automatically. For automated sampling, a sampling port takes a sample of pulp from the stock line and conveys it to the instrument chamber. For pulp of low consistency (less than 6%), the pulp sample is taken by opening a valve and allowing the pulp to flow out. At higher consistency, the pulp is pulled out of the line by the action of a piston. In either case, the pulp is conveyed along a line by flushing the line with cold water. Whether the sample is taken manually or automatically, once in the instrument chamber, the pulp sits over a mat screen and is washed thoroughly with water. The Kappa number of the pulp is then measured by a Xenon flash lamp with three detectors operating in the ultraviolet range. The STFI Opti-Kappa Analyzer works in a similar manner. It also conveys a 90 ml pulp sample from the stock line, in 4–6 minutes. The Kappa number is measured by using two UV detectors.

Automatic Kappa analyzers report data every few minutes, which is more rapid than the manual method. The drawback is the expense and maintenance associated with the instrument.

In addition to measuring the brownstock Kappa number, there are three common measurements of pulp as it enters the chlorination stage. These are (1) pulp consistency, (2) pulp brightness, and (3) residual bleaching chemical. These three measurements are carried out by almost every mill.

The pulp consistency is the solid content of pulp as it passes through the stock line. Clearly, the pulp consistency is an important measure of the amount of pulp present. Pulp consistency is measured and controlled by instruments sold by several companies, including Valmet Automation, BTG, and ABB. The instruments operate either based on the shear force delivered by the pulp fibers or by using optical measurements. The optical measurements may be of polarized light, such as the LC-100 instrument of Valmet. Alternatively, the optical measurements may be of infrared light, such as the TCA instrument of ABB. These pulp consistency measurements are continuous. The pulp brightness is measured by on-line instruments after the initial 30 seconds to 2 minutes of the chlorination stage. This pulp brightness achieved within the initial period of the stage gives an indication of the brightness that can be expected by the end of the stage. For the automatic detection of pulp brightness, several systems are available commercially. The BT-500 system of BTG uses four probes mounted on the pulp stock lines to measure the brightness of the pulp as it flows by. The probes operate at wavelengths of 480 nm, 560 nm, 650 nm, and infrared. Alternatively, the Pulpstar system of In-Line Sensors Inc. uses a tungsten-halogen lamp and two brightness detectors. On-line pulp brightness measurements are continuous.

The residual bleaching chemical is measured by on-line instruments after the initial 30 seconds to 2 minutes of the chlorination stage. The residual chemical remaining after the initial period of the stage is related to the Kappa number of the pulp and gives an indication of the chemical consumption that can be expected by the end of the stage. Automatic detection of residual chemical is carried out by on-line sensors such as a Polarox probe, which relates the amperage of the slurry to the concentration of bleaching chemical. On-line residual chemical measurements are continuous.

Further measurements are made at the end of the chlorination stage. These are usually manual measurements of pulp brightness and residual chemical and are primarily to confirm the readings of the on-line instruments. The manual measurement of pulp brightness is carried out by placing a dry pad of pulp in a brightness meter and detecting the brightness at a light wavelength of 457 nm, as described in TAPPI method T 452. The manual measurement of residual chemical is carried out by taking a sample of pulp liquor and titrating with sodium thiosulfate or other compounds to determine its concentration.

Some control measurements of pulp are made in the extraction and later stages. For pulp that has proceeded through the extraction stage, the most common measurement is of the Kappa number. This is carried out manually or automatically as described for brownstock. For pulp that has proceeded to the D1 stage, the brightness and residual chemical measurements are carried out as described for the chlorination stage. These measurements of pulp in these stages are useful in aiding the operators over the later bleaching stages by measuring the amount of bleaching chemical required in those stages.

In spite of the widespread usage of the various manual and automated measurements of Kappa number, pulp consistency, pulp brightness, and residual bleaching chemical, pulp mill operators still do not have a complete sense of the amount of bleaching chemical required to bleach the pulp. This lack of information causes the operators to overbleach pulp to achieve the brightness targets, at an added cost and waste of bleaching chemicals, or to overcompensate in decreasing chemicals, risking off-grade pulp.

The reasons for the shortcoming in the current control measurements is clarified by defining the terms bleach requirement and bleachability ( G. A. Smook, "Handbook for Pulp and Paper Technologists", p. 390).

Bleach requirement is the amount of bleaching chemical needed to bleach the pulp to a given level of brightness in a pulp mill. An example of bleach requirement is "30 Kg/t of chlorine dioxide bleaches a pulp to 90 brightness".

Bleachability is the bleach requirement of a pulp relative to its lignin content. The lignin content is often quantified by the Kappa number. One example of bleachability is in a comparison of two pulps with the same Kappa number: the pulp with the lower bleach requirement has a higher bleachability. As a second example, consider a mill that uses oxygen delignification to decrease the average lignin content of the pulp by 40% and decrease the average bleach requirement by only 30%. This use of oxygen delignification has decreased the bleachability of the pulp.

The concept of bleach requirement seems simple: if one knew the bleach requirement of pulp, one would just apply that much bleaching chemicals. Unfortunately, obtaining a direct measure of pulp bleach requirement has proven to be difficult. There are no instruments or methods for operators to use to do this. For such a method or instrument to be useful in a mill, it must (1) be an instrument of reasonably small size, (2) account for the effects observed in mill-scale pulp bleaching, without being confounded by artifacts created by working in a small scale, and (3) execute the measurements within a short time, perhaps 60 minutes, which is 5 to 20 fold shorter than the tilne required to bleach pulp in a mill. Small-scale measurements that do not scale up to the mill's operation are of little use to the operators. Information delivered over longer periods is not useful to the operators, as the properties of the unbleached pulp change with fluctuations in mill operations.

Several methods have been suggested to measure bleach requirement.

The laboratory-scale bleaching, otherwise known as "manual bleaching," of pulp is well known. Such bleaching is carried out by mixing the chemicals with pulp in Mason jars, plastic bags, or specially designed reactors such as the Quantum mixer, by Quantum Chemical Company, Twinsburg, Ohio, or the custom built titanium bleaching reactor at CPFP research in Hawkesbury, Ontario. These units and techniques enable the mill bleaching operation to be simulated in a laboratory. These methods and devices are therefore used to carry out bleaching at rates that match those in a mill, but not in the short times required for a bleachability assessment.

One device has been proposed to bleach pulp rapidly, the so-called BrineCell (BrineCell Inc., Salt Lake City, Utah). The BrineCell is a 2 liter reaction chamber filled with pulp and an aqueous solution of 10 to 40 g/L of sodium chloride. Electrodes at the base of the device convert the water and sodium chloride ions to a mixture of ozone, oxygen, hydrogen, chlorine, hydroxyl radicals, and sodium hypochlorite, which can oxidize the lignin and bleach the pulp. The process of generating the oxidizing products and bleaching the pulp is complete in 10 minutes. However, the BrineCell is not reported to simulate mill-scale bleaching of pulp, nor is the bleaching as carefully controlled as would be required to assess the bleach requirement of pulp.

The Roe chlorine number, TAPPI 253 om-92 (also called the Hypo number) has been used as an alternative to the Kappa number measurement. The Roe number measures uptake of chlorine in 10 minutes, rather than permanganate used in a Kappa number test. The Roe chlorine number extends the range of the Kappa number to include mechanical and semichemical pulps. However, the Roe chlorine number is no more related to pulp bleach requirement than the Kappa number.

Two mill-scale operations that save time in bleaching by neglecting washing can, in principle, be adapted to laboratory equipment. The first scheme that neglects washing of the pulp between bleaching stages is known as displacement bleaching (Reeve and Dence, p. 609). Unfortunately, displacement bleaching increases chemical usage relative to conventional bleaching and thereby does not simulate accurately conventional bleaching. A second approach to neglecting washing of the pulp is the Histed DnD bleaching sequence (Reeve and Dence, p. 385), which carries out a 5 minute chlorine dioxide stage and a 3 minute extraction stage without intermediate washing. However, although the Histed sequence carries out these two stages quickly, it is not useful for assessing pulp bleachability because it requires pulp to have passed through a chlorination stage and it requires a lengthy (4 hour) final D stage.

A third mill operation that is of some interest is the Papricycle wash stage (Reeve and Dence, p. 315). In Papricycle, chlorinated pulp is adjusted to pH 7 with alkine filtrate. The pulp is held at this pH and then adjusted to pH 10 for a conventional extraction. Therefore, Papricycle carried out on the laboratory scale does not save time in bleaching.

In the absence of a direct measure of bleach requirement, methods have evolved which measure bleach usage at a single stage, including chlorination stage measurements of pulp brightness and residual bleaching chemical. These methods are limited to addressing the pulp bleach requirement at the specific stage.

The other approach is to measure the lignin content, such as with the Kappa number, and use this to estimate the bleach requirement. This strategy leads to the concept of pulp bleachability.

A quantitative measure of the pulp bleachability is the molecular chlorine multiple, also known as the total Kappa factor (Reeve and Dence, p. 249), which is defined by Equation (1):

$$TKf = \frac{\text{Equivalent chlorine (\% on pulp)}}{\text{Kappa number}} \quad (1)$$

In Equation (1), chlorine dioxide has 2.63 Kg equivalent chlorine per Kg $ClO_2$, chlorine has 1.0 Kg equivalent chlorine per Kg $Cl_2$, and hydrogen peroxide has 2.09 Kg equivalent chlorine per Kg $H_2O_2$.

If all pulps had the same bleachability, then the TKf to bleach all pulps would be the same. A measurement of Kappa number would then accurately determine the amount of bleaching chemical required to bleach pulp. However, this is not the case. There are many factors that cause the bleachability of pulps to vary almost hourly within a mill. Among these factors are:

1. The differences in the nature of the lignin in the pulp, as Kappa number varies. The TKf is higher at high and low Kappa numbers than at intermediate Kappa numbers. For softwood Kraft pulp cooked in a conventional digester, the TKf is at a minimum at Kappa number 25 to 30 and increases outside this range.

2. The differences in nature of the lignin in the pulp among wood species. For example, oak is more difficult to bleach than aspen or eucalyptus. Mills change species frequently and are vulnerable to changes in bleachability because of it.

3. The variability in a given digester. The bleachability is influenced by all of the primary digester operating variables, including alkalinity, H-factor, and sulfidity.

4. The use of hemicellulase enzymes. This is described in more detail, as follows. Hemicellulase enzymes act on the hemicellulose portion of the pulp. Hemicellulose in pulp consists of two types of structures with polysaccharide backbones: arabinoxylan and glucomannan. The enzymes that have shown benefit in bleaching include xylanases, arabanases, and mannanases, with xylanases the most common in commercial applications at pulp mills (Yee and Tolan, Pulp and Paper Canada, October 1997). The most significant benefit obtained with hemicellulase enzymes is an increase in the pulp bleachability such that the TKf decreases by 8% to 15%.

Hemicellulase enzymes are usually added to the brownstock. In most mills, the washed brownstock is stored in a high density storage tower before being pumped into the first bleaching stage. The enzyme is added to the pulp as the pulp is pumped into the high density storage tower, and acts on the pulp as it is flowing through this tower. Typically 20 minutes to three hours elapse before the pulp exits the storage tower; the monitoring and control of this retention time is discussed in Foody, et al, U.S. patent application Ser. No. 08/568,516. Upon exiting the storage tower, the pulp is ready to be bleached. The enzyme treatment, by removing a portion of the hemicellulose in the pulp, makes the pulp easier to bleach.

Hemicellulase enzymes enhance the bleachability of pulp without significantly changing the Kappa number, brightness, or the rate of chemical consumption in the chlorination stage. Therefore, the effects of hemicellulase enzymes is not detected by conventional mill instrumentation.

In the absence of a measurement of the bleachability of pulp, the Kappa number gives an incomplete and inaccurate assessment of the bleach requirement. It would be desirable to have a measure of bleachability at a pulp mill. Such a measure would improve the control of the bleach plant by taking into account factors that effect chemical use that are independent of the Kappa number, and therefore not accounted for by present instrumentation.

In summary, for a variety of reasons, none of the above-described approaches has proven effective in rapidly assessing the bleach requirement and bleachability of pulp. Several methods have been proposed to address the specific issue of the action of hemicellulase enzymes on pulp. These methods could supplement existing instrumentation and include:

1. Measuring the sugars released from the pulp by the enzyme. For example, xylanase releases xylose from pulp, and the amount of xylose released correlates with the degree of enhancement of the bleaching of the pulp. However, the detection of xylose in a pulp filtrate is too time consuming to offer sufficient feedback to the mill operators.

2. Measuring the decrease in hemicellulose content of the pulp caused by the enzyme. For example, xylanase enzymes decrease the xylan content of pulp. However, analysis of xylan content is a lengthy procedure that is too time consuming for feedback to the mill operators.

3. Measuring the increase in chemical oxygen demand (COD) of the pulp liquor. Hemicellulase enzymes release soluble sugars and other compounds into the pulp liquor that contribute to an increase in the COD of the pulp liquor. However, the increase in COD caused by the enzymes is small compared with the natural COD in the pulp liquor. Therefore, the increase in COD is not a sensitive measure of the action of hemicellulase enzymes.

4. Measuring the increase in extractable lignin. Hemicellulase enzymes increase the alkaline extractability of lignin out of the pulp. However, the increase in extractability due to hemicellulase enzymes is small compared with the natural extractability of the lignin. Therefore, lignin alkaline extractability is not a sufficiently sensitive measure of the extent of enzyme treatment.

5. Measuring the residual enzyme activity in the pulp after enzyme treatment. This is the method taught by Freiermuth, et al, Canadian patent application 2,146,207. The shortcoming of this method is that it is a determination of the activity of the enzyme and not the effectiveness of enzyme treatment of the pulp.

In summary, for a variety of reasons, none of these five approaches has proven effective in assessing the extent or effectiveness of hemicellulase enzyme treatment at a pulp mill.

Therefore, there are no instruments or methods available to enable operators to know the bleach requirement, pulp bleachability, or effectiveness of enzyme treatment of pulp in a timely manner. In the absence of this information, the operators can overbleach pulp, which leads to excess bleaching chemicals and costs, or underbleach pulp, which produces off-grade product.

SUMMARY OF THE INVENTION

We have discovered a method and a device for rapidly measuring the bleach requirement, bleachability, and effectiveness of hemicellulase enzyme treatment of pulp. Our invention enables pulp mill operators to determine more accurately the amount of bleaching chemicals required to bleach the pulp. Our invention produces measurements of sufficient sensitivity, accuracy, and speed to be useful to pulp mill operators in controlling the bleach plant. This, in turn, will enable the pulp mill operators to better control the operating conditions under which the pulp is bleached and thereby ensure a higher quality, more economical final product. Our invention overcomes the limitations in existing instruments and methods used in pulp mills, which do not take into account differences in bleachability among pulps.

In one aspect of our invention, a method for selectively determining the bleach requirement, bleachability, and effectiveness of hemicellulase enzyme treatment of pulp comprises providing a pulp sample into a reaction chamber; controlling the amount of the pulp sample in the reaction chamber; conducting optical measurements of the pulp sample; bleaching the pulp sample in the reaction chamber in a controlled manner; processing the optical measurements to calculate an optical lignin content of the pulp sample; processing the optical measurements to calculate a rapid bleaching brightness of the pulp sample; and processing the rapid bleaching brightness of the pulp sample and the optical lignin content of the pulp sample to selectively determine the bleach requirement, bleachability, and effectiveness of hemicellulase enzyme treatment of the pulp sample, wherein said method is conducted in less than about 60 minutes.

In another aspect, our invention includes a method for determining a rapid bleaching brightness of a pulp, said method comprising providing a pulp sample into a reaction chamber; controlling the amount of the pulp sample in the reaction chamber; conducting optical measurements of the pulp sample; bleaching the pulp sample in the reaction chamber in a controlled manner; and processing the optical measurements to calculate a rapid breaching brightness of the pulp sample after the bleaching step, wherein said method is conducted in less than about 60 minutes.

In still another aspect of our an invention, a device for selectively determining the brightness value, lignin content value, bleach requirement, bleachability, and effectiveness of hemicellulase enzyme treatment of pulp comprises a reaction chamber; a sampling device communicating with said reaction chamber, for providing a pulp sample into said reaction chamber; an optical system for conducting optical measurements of said pulp sample in said reaction chamber; and a logical controller for storing said optical measurements and processing said optical measurements to selectively determine rapid bleaching brightness, optical lignin content, bleach requirement, bleachability, and effectiveness of hemicellulase enzyme treatment of said pulp sample.

In yet another aspect, our invention includes a device for selectively determining the rapid bleaching brightness, optical lignin content, bleach requirement, bleachability, and effectiveness of hemicellulase enzyme treatment of pulp, said device comprising a reaction chamber; a second chamber communicating with said reaction chamber; a sampling device communicating with said reaction chamber, for providing a pulp sample into said reaction chamber; an optical system for conducting optical measurements of said pulp sample in said reaction chamber and said second chamber; and a logical controller for storing said optical measurements and processing said optical measurements to selectively determine the rapid bleaching brightness, optical lignin content, bleach requirement, bleachability, and effectiveness of hemicellulase enzyme treatment of said pulp sample.

In still another aspect of our invention, a method of small-scale bleaching of pulp comprises providing a pulp sample of no greater than about 3000 grams dry weight into a chamber; after said providing step, adding at least one compound for bleaching the pulp sample into the chamber to create a bleaching medium in the chamber; and adding an alkaline compound in an effective amount to deactivate the bleaching medium and maintain the bleaching medium at an alkaline pH level in the chamber, wherein said method is conducted within less than about 60 minutes.

In still another aspect, our invention includes a method of small-scale bleaching of pulp comprising providing a pulp sample of no greater than about 3000 grams dry weight into a chamber; after said providing step, adding at least one compound for bleaching the pulp sample into the chamber to create a bleaching medium in the chamber; and adding an acidic compound in an effective amount to deactivate the bleaching medium and maintain the bleaching medium at an acidic pH level in the chamber, wherein said method is conducted within less than about 60 minutes.

In another aspect of our invention, an optical system for conducting optical measurements comprises a light source having an axis of illumination extending from said light source; at least one detector positioned in the optical system to receive optical measurements of said light source in a direction mainly orthogonal to said axis of illumination extending from said light source.

Other aspects of our invention will be better understood and advantages thereof more apparent in view of the following detailed description of the preferred embodiments and accompanying drawings, in which like reference numerals have been used for like or corresponding components throughout.

DETAILED DESCRIPTION OF THE PREFERRED EMBODIMENTS

Figure 1:
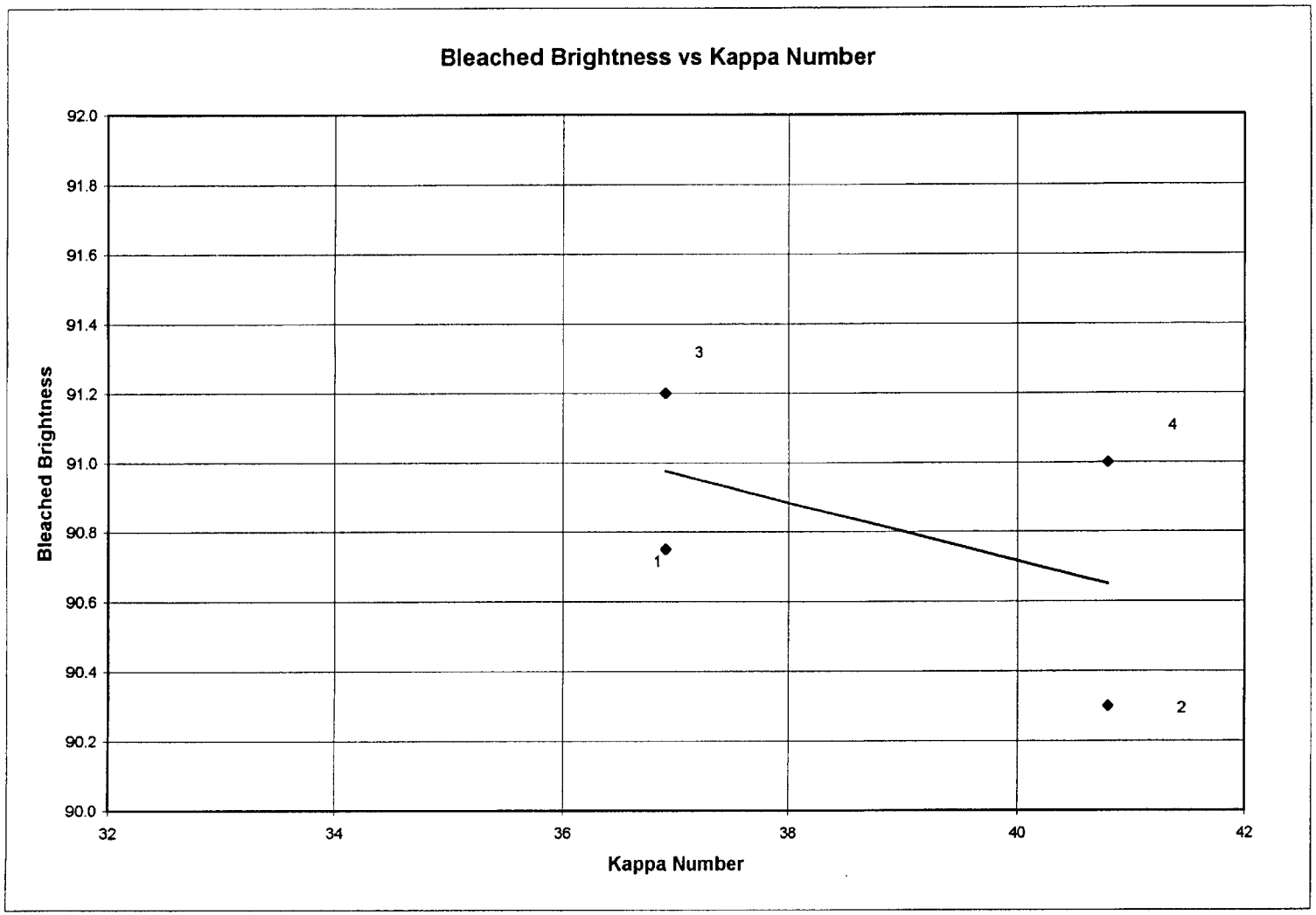
FIG. 1 shows the bleached brightness of four pulps, as a function of the Kappa number.

The preferred embodiments are described in detail by first defining the following terms. Pulp comprises wood and/or nonwood fibers. In a preferred embodiment, the pulp comprises wood fibers.

The pulp comprises virgin and/or secondary fibers. In a preferred embodiment, the pulp comprises virgin fibers.

The pulp is made by mechanical, chemical, or semichemical pulping processes. In a preferred embodiment, the pulp is made by a chemical pulping process. In a more preferred embodiment, the pulp is made by the Kraft process.

Bleach requirement refers to the amount of bleaching chemical required to bleach the pulp to a given level of brightness in a pulp mill.

Bleachability is the bleach requirement of pulp relative to its lignin content. Bleachability can be expressed as a Total Kappa factor "TKf" (by Equation 1) to achieve a given brightness.

Example 1 shows an expression of bleach requirement and bleachability.

Hemicellulase enzyme treatment of pulp refers to the addition of hemicellulase enzyme to pulp in a pulp mill, and the resulting action of the enzyme on the pulp.

Hemicellulase enzymes include any of the enzymes that act on pulp hemicellulose, alone or in combination. Some of the more prominent of these enzymes are xylanase, mannanase, arabinase, acetyl esterase, alpha-glucuronidase, and beta-xylosidase. Commercial examples of these enzymes include GS35, HS70, and HB60C, all made by logen Corporation of Ottawa, Canada; Pulpzyme HA, HB, and HC of Novo Nordisk Bioindustrials, Franklinton, N.C.; and EcoPulp XM, EcoPulp T, and EcoPulp X-200, of Primalco Ltd., Rajamaki, Finland.

When practicing our invention, we prefer to carry out the enzyme treatment on the brownstock pulp prior to the chlorination stage. This was the procedure used in Examples 1,3, and 8. The practice of the invention, however, is not limited to this location for hemicellulase enzyme treatment.

Enzyme treatment is typically carried out using the following procedures: (a) the enzyme is added to the pulp using a spray bar, line injection, repulper addition, or other means described by Tolan and Guenette, "Use of Xylanase Enzymes in a Mill", Canadian Pulp and Paper Association 1995 Bleaching Course; (b) the pH and temperature of the pulp are adjusted to the appropriate ranges, if necessary, by the methods described by Tolan and Guenette, and (c) enzyme is added to pulp immediately prior to the high density pulp storage tower, and acts on the pulp while it traverses this tower. However, the invention is not restricted in scope to this method and encompasses alternative procedures for adding enzyme to the pulp.

Effectiveness of hemicellulase enzyme treatment is the effect of the enzyme treatment on the bleach requirement or bleachability of the pulp. Those skilled in the art will recognize a variety of quantitative measures used to characterize the effectiveness of hemicellulase enzyme treatment, including but not limited to percentage decrease in bleach requirement, percentage decrease in total Kappa factor, absolute chemical savings in Kg per tonne of pulp produced, points increase in brightness, etc. The Examples illustrate methods of expressing hemicellulase effectiveness.

The effectiveness of enzyme treatment is expressed by comparing the desired property (i.e. bleach requirement) of enzyme treated pulp relative to that without enzyme treatment. In common practice, this might mean comparing pulp that has gone through an enzyme treatment stage with pulp that has not been treated. Other practices are possible and are included within the scope of this invention.

Conducted in less than about 60 minutes refers to the time elapsed between the taking of the sample of pulp from the stock line and the determination of the bleach requirement, bleachability, and/or effectiveness of hemicellulase enzyme. This period is the maximum length of time in which the feedback of information to the operators is useful for controlling the bleach plant.

In a preferred embodiment, a determination is made is less than about 30 minutes. Example 2 illustrates the use of such a device.

In another preferred embodiment, selective determination is made. Selective determination includes any combination of bleach requirement, bleachability, and effectiveness of hemicellulase enzyme treatment. The skilled practitioner will realize that some situations or mills will require one, two, or all three of these determinations. For example, a mill that is not using hemicellulase enzymes will not need a determination of enzyme effectiveness. The practice of the invention includes any combination of these three determinations.

Reaction chamber refers to any device in which chemical bleaching of pulp can be carried out. The reaction chamber may be constructed of any material that withstands the chemicals present. In a preferred embodiment, the reaction chamber is constructed of titanium.

Providing a pulp sample to a reaction chamber describes the placement of a pulp sample within the reaction chamber.

The pulp sample can be provided to the reaction chamber manually or automatically. In a preferred embodiment, the pulp sample is conveyed to the reaction chamber by an automatic sampling unit. An example of such a sampling device is the BTG HT-5000 sampling device.

The pulp sample can be of any size that can be processed. In a preferred embodiment, the pulp sample is between about 1 and about 3000 grams dry weight. In a more preferred embodiment, the pulp sample is between about 1 and about 100 grams dry weight. Such sample sizes permit convenient handling and bleaching.

The pulp sample can be taken at any location in a pulp mill. In a preferred embodiment, in mills with oxygen delignification, the pulp sample is taken after the oxygen delignification. In a preferred embodiment, the pulp sample is taken prior to the third bleaching stage. In a more preferred embodiment, the pulp sample is taken prior to the first bleaching stage. In another more preferred embodiment, the pulp sample is taken immediately after a hemicellulase enzyme treatment stage.

The pulp sample may or may not be washed with water in the reaction chamber. In a preferred embodiment, the pulp is washed with water in the reaction chamber. In a more preferred embodiment, the pulp is washed with water across a cross-flow filter.

Controlling the amount of the pulp sample in the reaction chamber refers to achieving a set amount of dry weight of pulp in the reaction chamber prior to bleaching. This requires measuring the amount of pulp added, and adding more pulp if less than the set amount of pulp is added, or removing pulp if more than the set amount of pulp is added.

In a preferred embodiment, the amount of pulp in the reaction chamber is controlled with a consistency controller.

The consistency controller can be based on measurement of shear force or can be an optical device. In a preferred embodiment, the consistency controller is an optical device.

The optical device can detect any types of light, including polarized light or infrared light. In a preferred embodiment, the optical device of the consistency controller measures the absorbance of infrared light. This is illustrated in Example 2.

Conducting optical measurements of the pulp sample refers to measuring the absorbance or reflectance of the pulp sample (including before bleaching, during bleaching, after bleaching, or any combination thereof) using an optical system, which is described below in greater detail. Preferably, optical measurements of the pulp sample are made continuously, as described below in the Examples, during the operation of our device.

In a preferred embodiment, the optical measurements include ultraviolet and infrared reflectance measurements and infrared absorbance measurements. It is believed that visible absorbance and reflectance measurements are also preferred measurements. In a more preferred embodiment, multiple measurements of ultraviolet and infrared reflectance and infrared absorbance are made to account for the nonuniformity of the pulp.

Optical measurements of the pulp may be conducted either within the reaction chamber or outside the reaction chamber in another chamber. In a preferred embodiment, the optical measurements are conducted in the reaction chamber.

Optical system refers to an arrangement of optical components designed to perform a measurement function, such as absorbance or reflectance of light. Preferably, the optical components include, without limitation, a light source, a light transport medium, light wavelength selection devices, and detectors.

Preferred light sources include ultraviolet, visible, infrared, and near infrared light sources. More preferred is a light source that provides both ultraviolet and infrared light. Most preferred is a light source that provides ultraviolet, infrared, and near infrared light. A preferred type of light source is a direct current mercury arc lamp.

A preferred light transport medium is a fiber optic. The fiber optic preferably can transmit both the ultraviolet and infrared range of wavelengths.

Light wavelength selection devices include wavelength selection filters. Preferred filters include glass or di-electric film optical filters.

Preferably detectors include silicon photodetectors, most preferably ultraviolet enhanced silicon photodetectors.

A preferred optical system includes a light source having an axis of illumination extending from said light source; and at least one detector positioned in the optical system to receive optical measurements of the light source in a direction mainly orthogonal to the axis of illumination extending from the light source. By "a direction mainly orthogonal," we mean the optical system receives measurements in a direction extending between about 70 and about 110 degrees from the axis of illumination; more preferably between about 80 and about 100 degrees from the axis of illumination; and most preferably between about 89 and about 91 degrees from the axis of illumination.

Processing the optical measurements to calculate the optical lignin content of the pulp refers to measuring the amount of lignin in the pulp, in terms of a "optical lignin content," based on the optical measurements.

In a preferred embodiment, processing the optical measurements to calculate the optical lignin content includes processing ultraviolet and near infrared reflectance measurements and infrared absorption measurements. A preferred method of calculating optical lignin content from optical measurements is set forth in Example 6. However, one of ordinary skill in the art will recognize that various other methods and equivalent approaches may be employed to optically determine the lignin content in the pulp. All such equivalents are within the scope of the invention.

In a more preferred embodiment, Optical lignin content is calculated from measurements of reflectance of ultraviolet light and infrared light carried out simultaneously with measurements of the amount of pulp in the reaction chamber.

Bleaching the pulp sample in the reaction chamber refers to the introduction of at least one chemical compound into the reaction chamber, to be used to bleach the pulp. The compound(s) may be added manually or automatically pumped into the reaction chamber. The compound(s) need not be identical to those used in the mill to bleach the pulp.

The compound(s) added to the reaction chamber can include oxidizing (i.e., bleaching) chemicals and non-oxidizing (i.e., non-bleaching) chemicals. Preferably, chlorine dioxide is used as a bleaching chemical. Other bleaching chemicals include, without limitation, chlorine, sodium hypochlorous acid, hydrogen peroxide, sodium hypochlorite, sodium hydrosulphite, potassium permanganate, ozone, oxygen, nitrous oxide, and peracetic acid.

Alternatively, two or more non-bleaching chemicals, which cannot oxidize lignin separately, but when placed together generate a bleaching chemical, can be added to the reaction chamber. One example of this is the addition of sodium chlorite and an acid (hereafter "acidified sodium chlorite"). The acid generates chlorine dioxide, which can then be used to bleach pulp. We prefer to use sulfuric acid with sodium chlorite. Other acids include, without limitation, sulfurous acid, hydrochloric acid, phosphoric acid, and nitric acid.

In a preferred embodiment, at least one compound for bleaching the pulp sample is added. In another preferred embodiment, the compound includes at least one of chlorine, chlorine dioxide, hypochlorous acid, hydrogen peroxide, sodium hypochlorite, sodium hydrosulphite, potassium permanganate, ozone, oxygen, nitrous oxide, or peracetic acid.

In a more preferred embodiment, the bleaching compound is chlorine dioxide. In a most preferred embodiment, the compounds are sodium chlorite and an acid. Bleaching the pulp in the reaction chamber in a controlled manner refers to bleaching pulp in a reaction chamber with automated timing and addition, withdrawal, and control of concentrations of chemicals and water. The Examples illustrate various embodiments of carrying out bleaching in a controlled manner.

In a preferred embodiment, the bleaching is conducted through a first stage in which at least one compound for bleaching the pulp is added to create a bleaching medium in the reaction chamber, followed by an alkaline stage in which at least one alkaline compound is added in an effective amount to deactivate the bleaching medium and maintain the bleaching medium at an alkaline pH level in the reaction chamber. We prefer to use sodium hydroxide as the alkaline compound. Other alkaline compounds include, without limitation, potassium hydroxide, sodium carbonate, ammonia, and ammonium hydroxide.

In another preferred embodiment, the bleaching is conducted through the first stage, followed by an acidic stage in which at least one acid compound is added in an effective amount to deactivate the bleaching medium and maintain the bleaching medium at an acidic pH level in the reaction chamber. We prefer to use sulfuric acid as the acid compound. Other acid compounds include, without limitation, sulfurous acid, hydrochloric acid, phosphoric acid, and nitric acid.

In another preferred embodiment, the bleaching is conducted through the first stage, followed by an alkaline stage in which at least one alkaline compound is added in an effective amount to deactivate the bleaching medium and maintain the bleaching medium at an alkaline pH level in the reaction chamber, which in turn is followed by an acidic stage in which at least one acid compound is added in an effective amount to reactivate the bleaching medium and maintain the bleaching medium at an acidic pH level in the reaction chamber. Subsequent stages alternating between alkaline and acidic may be carried out. Preferred acid and alkaline compounds are the same as those discussed above.

In another preferred embodiment, the bleaching is conducted through the first stage, followed by an acidic stage in which at least one acid compound is added in an effective amount to deactivate the bleaching medium and maintain the bleaching medium at an acidic pH level in the reaction chamber, which in turn is followed by an alkaline stage in which at least one alkaline compound is added in an effective amount to reactivate the bleaching medium and maintain the bleaching medium at an alkaline pH level in the reaction chamber. Subsequent stages alternating between alkaline and acidic may be carried out. Preferred acid and alkaline compounds are the same as those discussed above.

Also, washing of the pulp may be carried out after any stage, as desired. In a preferred embodiment, washing is carried out only as a final stage after bleaching has been carried out.

Preferably, each acidic stage is maintained at a pH below about 5, and each alkaline stage is maintained at a pH above about 8.

In still another preferred embodiment, each of the first stage, the acidic stage, and the alkaline stage requires from about 10 seconds to about 5 minutes.

In a preferred embodiment, the amount of bleaching chemicals in the reaction chamber, either added directly or generated in place, corresponds to a total Kappa factor of about 0.05 to about 1.2, as calculated according to Equation (1). We have found that this amount results in the best estimate of hemicellulase enzyme effectiveness.

Rapid bleaching brightness refers to the brightness of the pulp after it is bleached in the bleaching chamber.

Processing the optical measurements to calculate a rapid bleaching brightness refers to measuring the brightness of the pulp in terms of rapid bleaching brightness based on the optical measurements.

In a preferred embodiment, processing the optical measurements to calculate a rapid bleaching brightness includes processing ultraviolet and near infrared reflectance measurements and infrared absorption measurements. A preferred method of calculating rapid bleaching brightness from optical measurements is set forth in Example 2. However, one of ordinary skill in the art will recognize that various other methods and equivalent approaches may be employed and are included within the scope of this invention.

Processing the rapid bleaching brightness and the optical lignin content to determine the bleach requirement, bleachability, and effectiveness of hemicellulase enzyme treatment refers to relating the rapid bleaching brightness and optical lignin content to the chemical usage and bleached brightness of pulp bleached in a pulp mill. The Examples illustrate various embodiments of carrying out such processing. In a preferred embodiment, this processing is carried out by a computer.

Other preferred embodiments are further illustrated by the following examples.

EXAMPLE 1

Illustration Of Bleach Requirement Measurement By The Rapid Bleaching Instrument The purpose of Example 1 is to provide a direct illustration of the capabilities of the rapid bleaching instrument in assessing the bleach requirement of pulp.

Four softwood Kraft brownstock pulps were used in this study. The pulps were all from a mill in western Canada and are described as follows.

Pulp 1: Kappa number 36.8.

Pulp 2: Kappa number 40.7

Pulp 3: Pulp 1, with xylanase enzyme treatment. The pulp was treated with HB60C xylanase, a commercial product of Iogen Corporation. The enzyme was added at a dosage of about 1000 ml per tonne pulp, at about pH 6.5 and about 60 C, for one hour. The Kappa number of the pulp was not changed by enzyme treatment.

Pulp 4: Pulp 2, with xylanase enzyme treatment. The pulp was treated with HB60 C xylanase, a commercial product of Iogen Corporation. The enzyme was added at a dosage of about 1000 ml per tonne pulp, at about pH 6.5 and about 60 C, for one hour. The Kappa number of the pulp was not changed by enzyme treatment.

The four pulps were bleached manually, using identical 5-stage bleaching sequences DoEoDED, and two levels of chlorine dioxide. The total amount of chlorine dioxide added to each pulp was 42 and 47 Kg/t, after which the bleached brightnesses were measured. This testing required 3 days.

The results are shown in FIG. 1. For clarity, only the results with 47 Kg/t of $ClO_2$ are shown. The bleached brightness does not correlate with Kappa number. The Kappa number does not provide a good basis to control the bleach plant.

Figure 2:
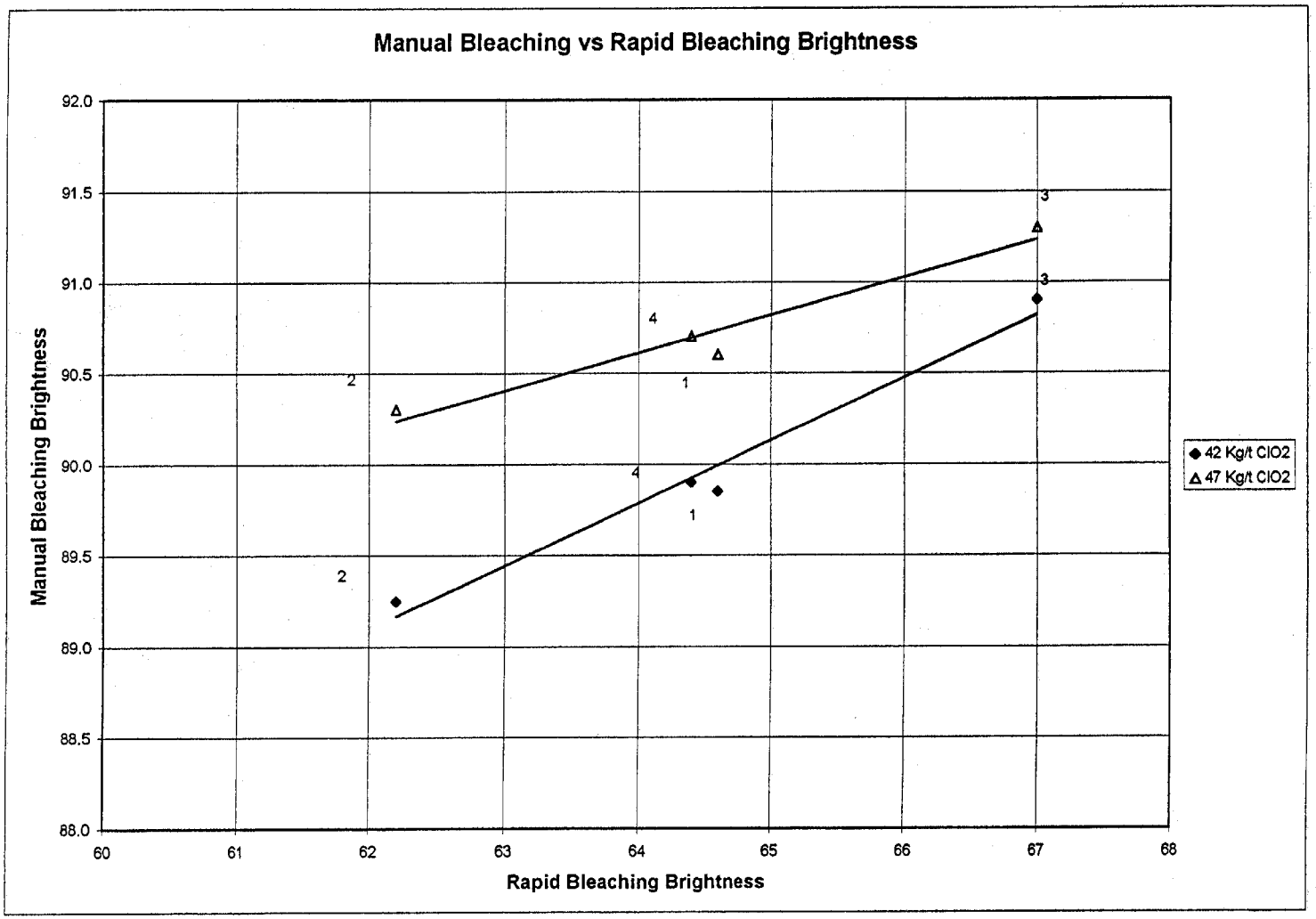
FIG. 2 shows the bleached brightness of the four pulps, as a function of the brightness measured by the rapid bleaching device.

The four pulps were also bleached in the rapid-bleaching device, whose operation is described in Example 2. This testing required less than 1 hour per pulp sample. The results are shown in FIG. 2. The rapid-bleached brightness correlates very well with the actual bleached brightness achieved with manual bleaching methods at both chemical levels.

Our rapid bleaching device provides the possibility of controlling the amount of $ClO_2$ or other bleaching chemicals added to the pulp while maintaining the desired pulp quality without wasting chemical. From FIG. 2, if the mill desires a final brightness of 90 ISO and the rapid bleaching brightness is 65.4 ISO, the mill should use 42 Kg/t of $ClO_2$. If the rapid brightness drops to 63.0 ISO, the $ClO_2$ level should be increased to about 44.5 Kg/t, midway between 42 and 47 Kg/t, to maintain 90 ISO brightness. Table 1 shows the bleach requirement, bleachability, and hemicellulase enzyme effectiveness for the 4 pulps.

TABLE 1

| Pulp | Comments | Kappa number | Bleach requirement (Kg/t to 90 ISO brightness)* | Bleachability (Tkf to 90 ISO brightness)** | Hemicellulase effectiveness |
|---|---|---|---|---|---|
| 1 | As is | 36.8 | 43 | 0.307 | Not applicable |
| 2 | As is | 40.7 | 45.5 | 0.294 | Not applicable |
| 3 | #1 with xylanase | 36.8 | 40.5 | 0.289 | Save 6% |
| 4 | #2 with xylanase | 40.7 | 42.5 | 0.275 | Save 7% |

*Values interpolated from FIG. 2
**Calculated using Equation 1.

EXAMPLE 2

Controlled Rapid Bleaching Of Brownstock Pulp

Softwood Kraft pulp was obtained from a mill in western Canada. The pulp was oxygen delignified and washed at the mill and then dewatered to 30% solids consistency. The Kappa number of the pulp was 18.1. The pulp was then subject to a controlled rapid bleaching process in a rapid bleaching device in accordance with our invention. The procedure and device we employed in Example 2 will be described with respect to FIGS. 3A and 3B. Our invention is not limited, however, to the rapid bleaching device and rapid bleaching process described herein.

Figure 3A:
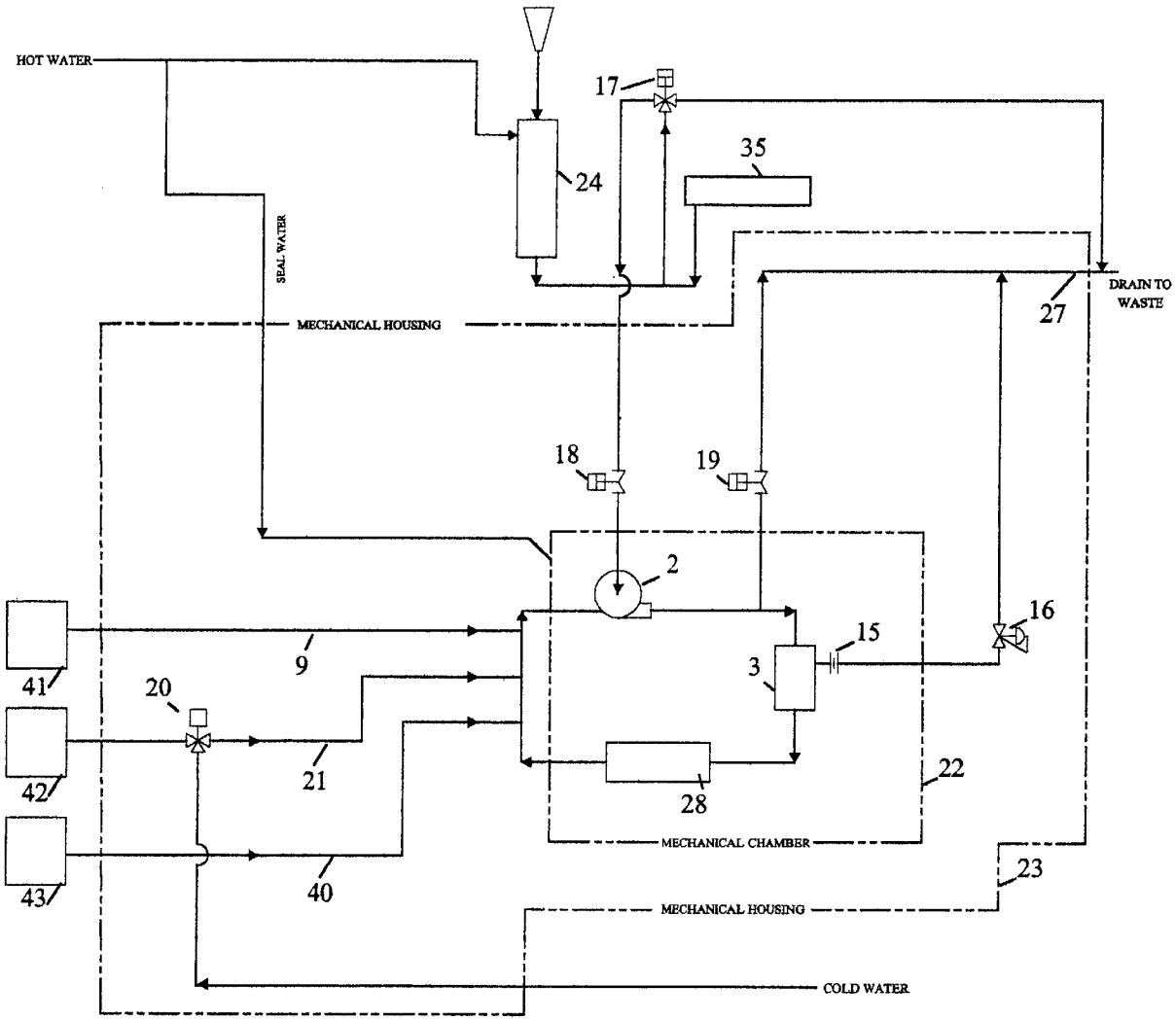
FIG. 3A is a schematic representation of an embodiment of a rapid bleaching device of the present invention.

A schematic of an embodiment of our rapid bleaching device is shown in FIG. 3A. Referring now to FIG. 3A, a rapid bleaching device comprises a mechanical housing 23, which houses a mechanical chamber 22, which in turn houses a reaction chamber 1 (shown in FIG. 3B).

A manual sample chamber 24 is connected to the mechanical housing 23 for providing a pulp sample into the rapid bleaching device. A water source (not shown) provides a water stream (preferably at 40 psi and regulated through regulator valves 17, 18) through the manual sample chamber 24 to transport the pulp sample contained therein.

Alternatively, an automatic sampler 35 may be used. A preferred automatic sampler is a BTG HDS 1010 sampler. The BTG HDS 1010 sampler mounts directly to a stock line and comprises a piston withdrawal assembly. When operating, a piston pulls about 90 ml of a substance from the stock line per stroke, and each stroke requires 15 seconds. Ideally, the pulp is 3% consistency in the stock line, and 5 strokes are used to pull the requisite amount of pulp sample. If the pulp consistency is less than about 1%, the number of strokes needed to obtain the pulp sample is too high. If the pulp consistency is greater than about 6%, the piston does not exert sufficient force to remove the pulp from the stock line.

In addition, chemical stocks 41, 42, 43 are connected to the housing through supply lines 9, 21, 40 respectively. In this example, stock 41 contains sulfuric acid, 12.5% conc. (w/w); stock 42 contains sodium chlorite, 4% conc. (w/w); and stock 43 contains sodium hydroxide, 16% conc. (w/w).

Figure 3B:
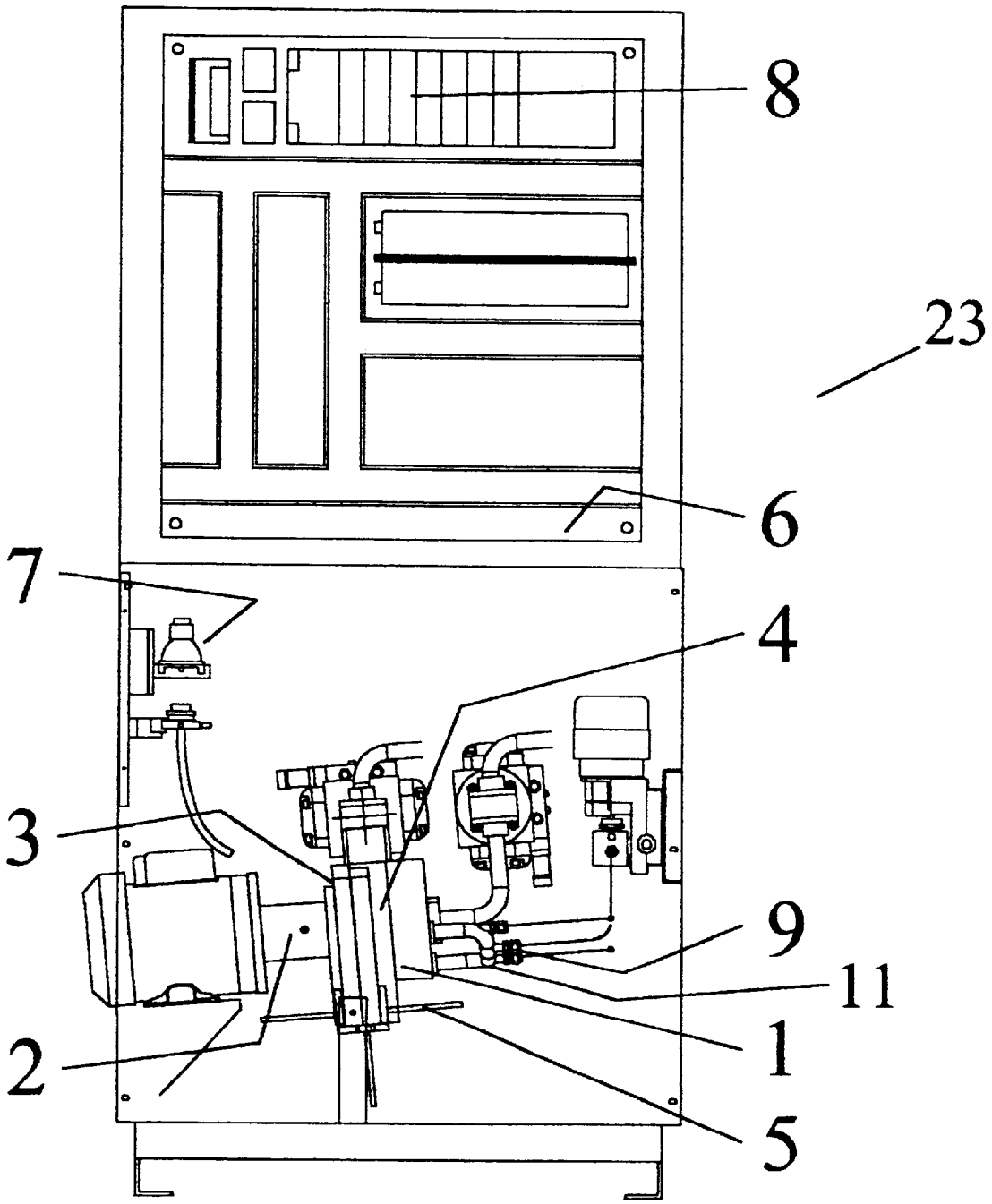
FIG. 3B is a close-up schematic of an embodiment of a mechanical chamber in a rapid bleaching device of this invention.

Mechanical housing 23 is depicted in greater detail in FIG. 3B. Turning now to FIG. 3B, pulp from manual sample chamber 24 or automatic sampler 35 is agitated by a 4-blade impeller 2. The action of the impeller forces the pulp through screen 3 and reaction chamber 1 into a sidestream 11. Preferably, screen 3 is made of titanium and is 5 inches long by 1.75 inches wide with pores of 150 microns. If pulp is provided from manual sample chamber 24, the wash water is heated to and maintained at 70 C by a combination of external hot water heaters (not shown) and internal heaters 4. Screen 3 acts as a crossflow filter for the washing. The cross-flow filter rates are controlled by a flow restriction 15 and pressure regulator 16; pressurization of the water and release of the pressure removes dissolved gas from the water. The filtrate is drained to waste through line 27.

Figure 4:
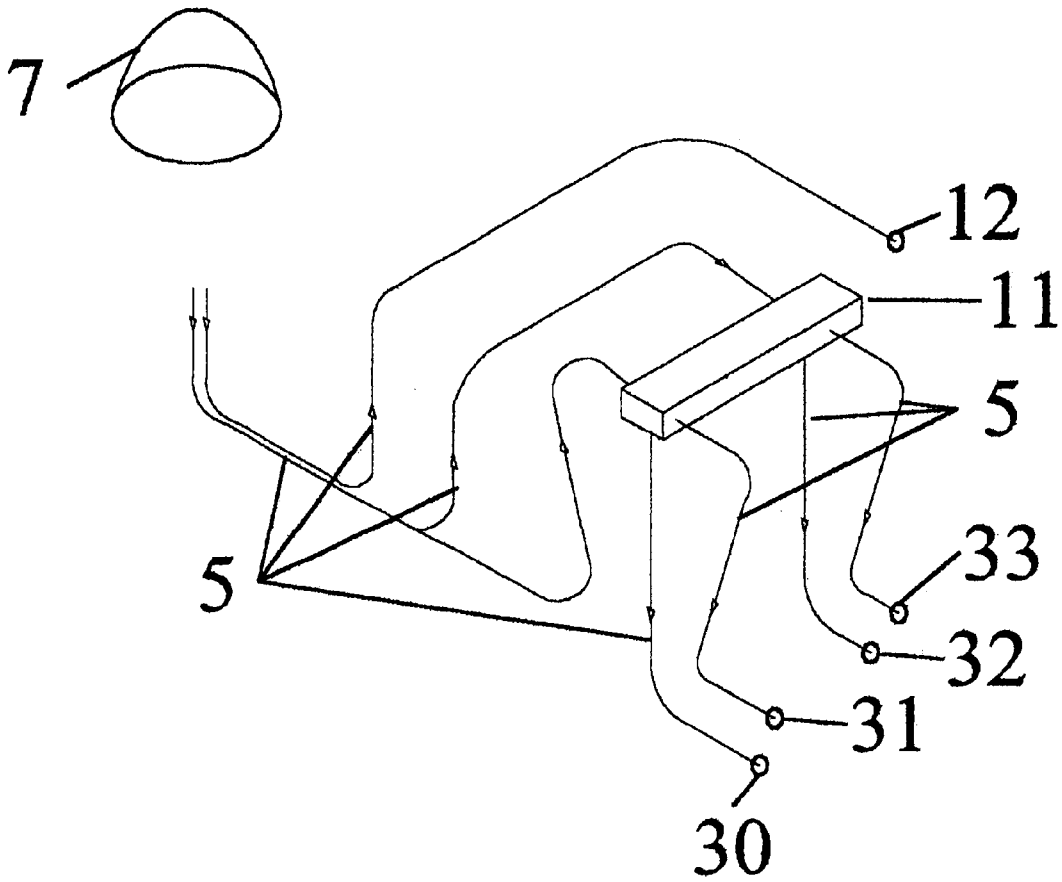
FIG. 4 is a schematic representation of an embodiment of an optical system in a rapid bleaching device of the present invention.

A schematic of the optic system 28 is shown in FIG. 4. Turning now to FIG. 4, the consistency of the pulp in the mechanical chamber 22 is measured by infrared detectors 31, 33. Preferably, infrared detectors 31, 33 are constructed of silicon and are made by EG&G. These infrared detectors preferably detect light transmitted from a light source 7 (preferably a direct current arc lamp) at wavelengths of 630 nm to 850 nm; the light is filtered through glass filters (not shown) on each of the detectors. We prefer to use a mercury-xenon Osram-Sylvania direct current arc lamp. The light is transported in fiber optic light guides 5 (preferably from Fibreguide Industries) to the silicon detector 6.

Signals are received at a rate of 1000 second and are processed by a logic controller 8. We prefer to employ a GE Fanuc programmable logic controller. The amount of light in the infrared range transmitted through the pulp is compared with that in the absence of pulp, according to Equation (2):

$$Abs=-\log(IRt/IRo) \quad (2)$$

Where Abs=absorbance measurement

IRt=infrared transmission

IRo=infrared transmission in the absence of pulp

The target absorbance corresponding to 8 grams of pulp is about 1.5 . If the absorbance is higher than this, the pulp is bled out a ½ inch valve until the absorbance drops to about 1.5. In this case, the absorbance was about 1.5, and there was no bleed of pulp.

With the target consistency of the pulp having been reached, the pulp is ready to be bleached. The bleaching sequence is controlled by the logic controller 8. The bleaching was carried out with the following sequence:

| Stage | Chemical | % on pulp | Time (sec) (includes addition) | pH |
|---|---|---|---|---|
| D | Sodium chlorite | 5.83 | 87 | 1.1 |
| | Sulfuric acid | 13.7 | | |
| E1 | Sodium hydroxide | 22 | 18 | 13.1 |
| A1 | Sulfuric acid | 35.2 | 87 | 0.9 |
| E2 | Sodium hydroxide | 22 | 20 | 12.9 |
| A2 | Sulfuric acid | 35.2 | 89 | 0.8 |

Each of the chemicals were provided through ¼ inch lines 9, 21, 40, at a flow rate of 125–150 ml/min. After sodium chlorite was added, line 21 is flushed with cold water at valve 20 before proceeding further. All of the stages are run at 70 C. At the conclusion of the A2 stage, the pulp was washed with water across the cross-flow filter screen 3 for 5 minutes.

The brightness of the bleached pulp is determined by using the readings from detectors 30, 32. Preferably, detectors 30, 32 are constructed of silicon and are EG&G UV245BG silicon detectors. These detectors preferably detect light of wavelengths in the UVA range (350+/−30 nm) and in the near infrared range (630–850 nm). Signals are received at a rate of 1000/second and are processed and stored in the logic controller 8.

Figure 5:
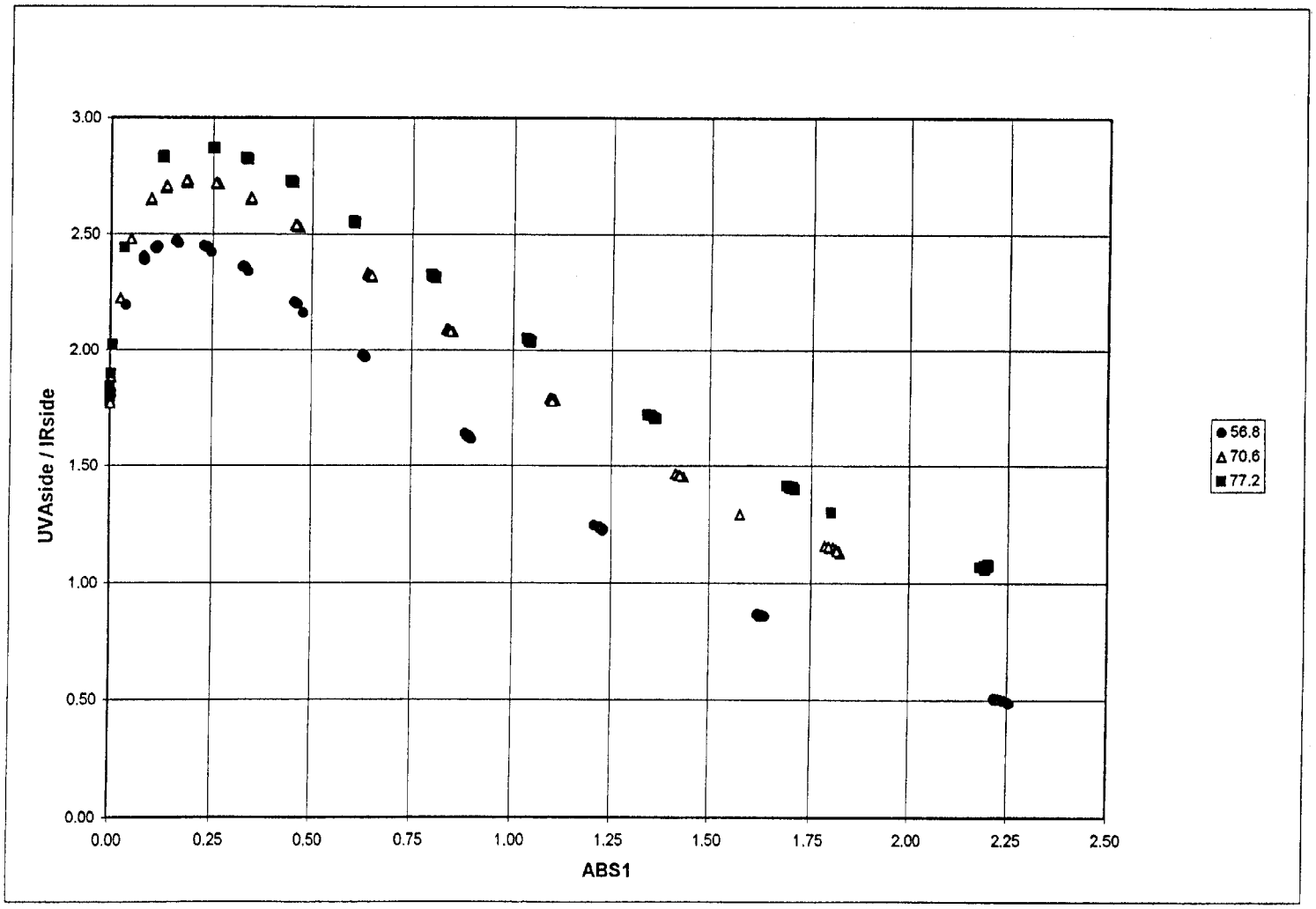
FIG. 5 is the calibration measurement for pulp brightness.

An example of such data for three test pulps, of brightnesses 56.8 ISO, 70.6 ISO, and 77.2 ISO is shown in FIG. 5. The data were fit to a second order polynomial in absorbance, Equation (3):

$$UVAside/IRside=B_{00}+B_{10}*ABS+B_{20}*ABS^2+Br*(B_{01}+B_{11}*ABS+B_{21}*ABS^2) \quad (3)$$

where Br=pulp brightness value

ABS=Absorbance based on the pulp consistency, from the transmitted IR readings

The Bxy constants are determined by calibration of the instrument with the three test pulps, each of which is oxygen delignified softwood Kraft pulp, and has brightness measured by an Elrepho brightness instrument at 457 nm. For this example, the calibration constants were:

B00=1.836

B10=−2.601

B20=0.588

B01=0.0211

B11=0.0126

B21=−0.00446

The signals measured by each detector are corrected for the variation of lamp output due to age or other factors using a reference 12.

The UVA and infrared readings from the side of the unit are related to the brightness of the pulp by solving Equation (3) for the pulp brightness value. The result is Equation (4):

$$B = \frac{\text{Side} - (B_{00} + B_{10} * \text{ABS} + B_{20} * \text{ABS}^2)}{(B_{01} + B_{11} * \text{ABS} + B_{21} * \text{ABS}^2)} \quad (4)$$

where Side=UVAside/IRside

B=rapid bleaching brightness, which is the brightness based on the optical measurements after rapid bleaching.

To determine the brightness value of a single pulp sample, 400 separate readings of Side and Abs are substituted into Equation (4) to generate brightnesses, and the average of these brightnesses is calculated and designated as a reading. For each sample, the brightness is read 50 times by each detector, and the recorded brightness is the average of the 4 detectors.

At this point, the pulp is flushed out of the chamber, through valve 19 and line 27 to waste. The time elapsed from adding the sample to the bleaching chamber to determination of the bleached brightness value is 17 minutes.

Figure 6:
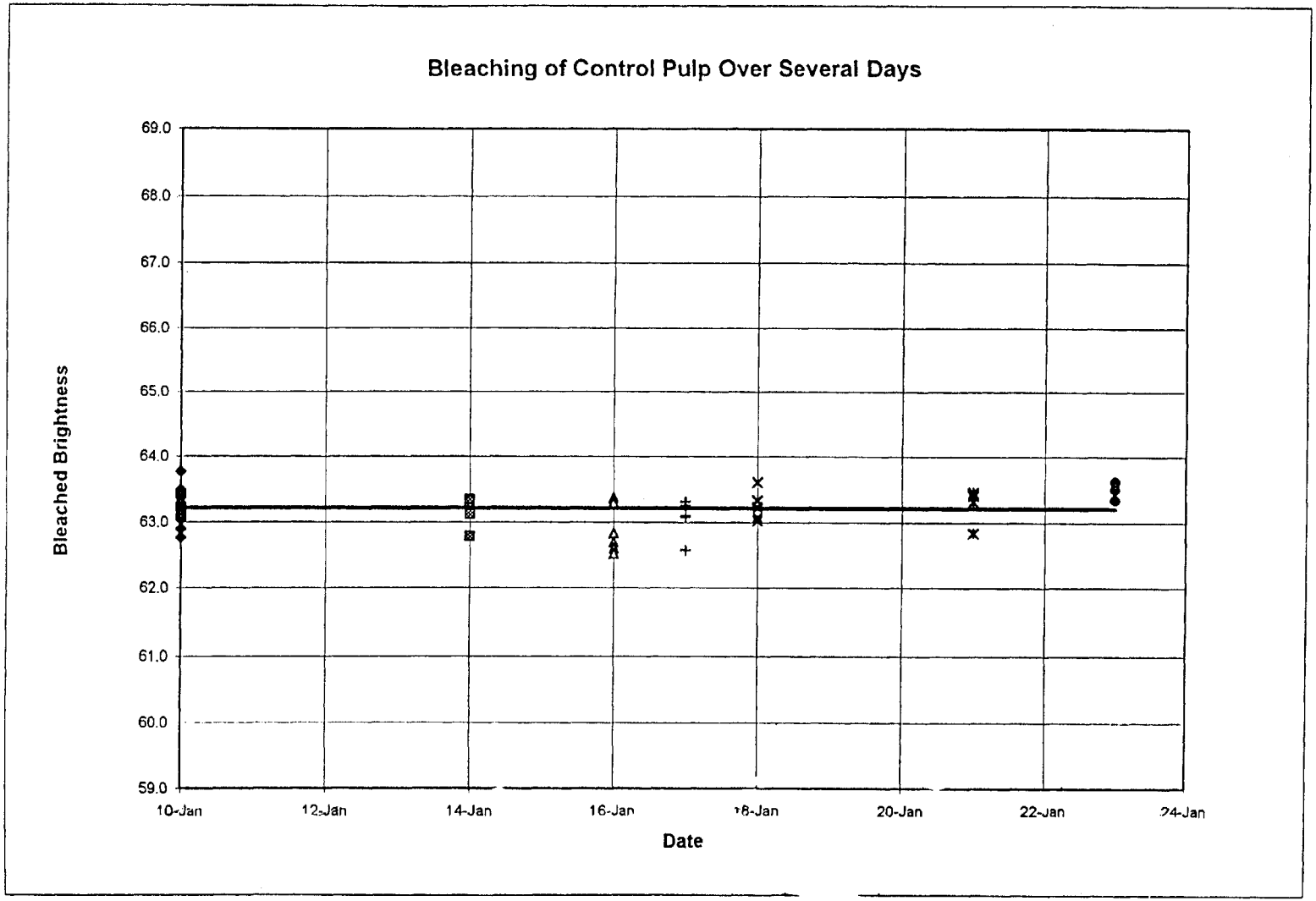
FIG. 6 is a plot of the bleached brightness of a control pulp over several days.

Samples of pulp from the same stock were bleached in the chamber 5 times per day over a period of 13 days. The results for the several tests are shown in FIG. 6. The bleached brightness averaged 63.2 ISO with a variance of only 0.28 ISO.

This result indicates the instrument is capable of bleaching pulp rapidly and with excellent reproducibility.

EXAMPLE 3

Bleaching Of Pulp From Different Days

The device described in Example 2 was used to rapidly bleach pulp samples taken over a period of several days. The pulp was obtained from the mill described in Example 2. The pulp samples were taken from the final brownstock washer ("Washer 25") and from the bottom of the brownstock high-density storage tower ("BHD"). HS70 xylanase enzyme, made by logen Corporation, was added to the pulp in the mill between the two locations. The enzyme was added to the pulp as a liquid solution at a rate of 150 milliliters per tonne of pulp. The enzyme was added with dilution water, sulfuric acid, and pulp filtrate in a manner consistent with Canadian patent 2,079,000. The enzyme acts on the pulp in the high-density storage tower.

The pulp samples were taken periodically and added to the rapid bleaching chamber and bleached, as described in Example 2. The results are shown in FIG. 7.

The bleached brightness of the Washer 25 pulp varied between about 60 and 68 ISO brightness. The bleached brightness of the BHD pulp varied between about 64 and 69 brightness. This result shows that the instrument can be used to bleach pulp samples taken periodically in a mill.

Figure 7:
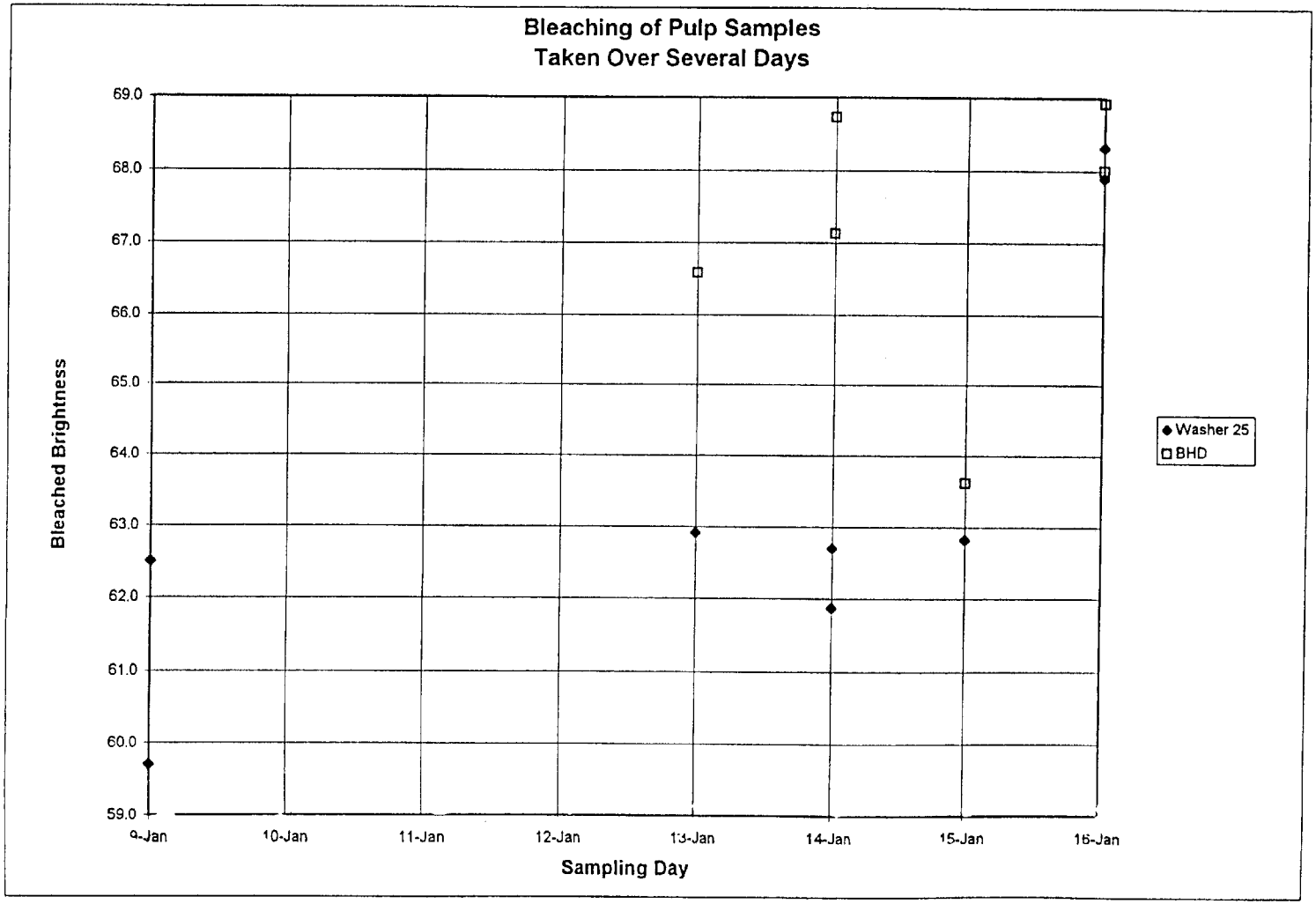
FIG. 7 is a plot of the bleached brightness of pulp from two locations in a mill over several days.

Based on FIG. 7, one might conclude that the higher brightness of the BHD pulp is due to the xylanase enzyme treatment of the pulp, which makes the pulp easier to bleach. However, while the BHD pulp has higher brightness on January 13 and 14 than the Washer 25 pulp, the two pulps are of similar brightness on January 15 and 16. Based on this data alone, it is not clear whether and when the enzyme treatment was effective. Examples 4, 5, and 6 explain the data more fully.

EXAMPLE 4

Effect Of Xylanase Enzyme Treatment On Bleached Brightness Of Pulp

A sample of pulp described in Example 3, from Washer 25, was manually treated with xylanase enzyme and then rapidly bleached by the bleaching device.

Specifically, samples of 10 grams of pulp (dry basis) were placed in heat-sealable plastic bags and topped up to a total of 100 grams with water. The pulp was adjusted to pH 6 with 1 N sulfuric acid, with the bags incubated at 50 C for 15 minutes to allow the pH to equilibrate. At this time, the bags were squeezed to allow about 30 grams of filtrate to sit separately from the pulp.

The hemicellulase enzyme was added to the filtrate. The enzyme consisted of Iogen HS70, a commercial xylanase enzyme preparation available from logen Corporation. The enzyme is standardized to a concentration of 7000 xylanase units per milliliter.

The enzyme was added to the filtrate at concentrations corresponding to 0 to 400 ml per tonne pulp. To facilitate enzyme addition, the HS70 enzyme was diluted in pH 5 citrate buffer to 1/100 of its initial strength. The enzyme was mixed in the filtrate, then the filtrate was kneaded into the pulp for one minute to obtain even dispersion of the enzyme into the pulp. The pulp bags were then sealed and incubated in a 50 C water bath for one hour.

At the end of this period, the pulp samples were processed in the rapid bleaching chamber, as described in Example 2. The results are shown in FIG. 8.

The bleached brightness increases with increased enzyme dosage. A dosage of 300 ml/t increases the bleached brightness by about three points. A dosage of 100 ml/t, which is what was added in the mill, increased the bleached brightness by about two points.

Figure 8:
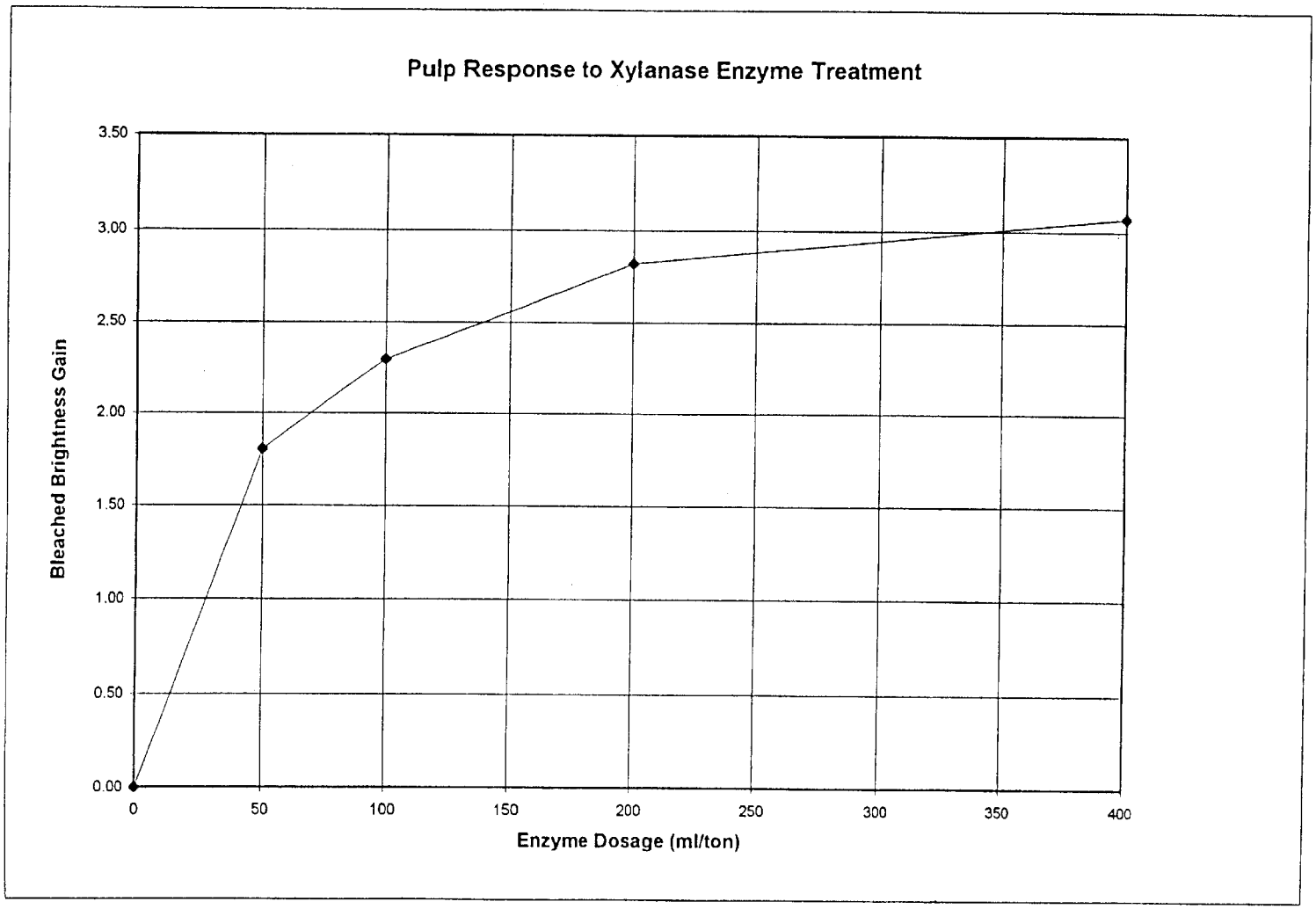
FIG. 8 is a plot of the increase in bleached brightness due to enzyme treatment of pulp.

Comparison of FIG. 8 with FIG. 7 indicates that the BHD pulp has a degree of enhanced bleaching over Washer 25 pulp that is higher than expected from xylanase alone on January 13 and 14, and less than that expected from xylanase on January 15 and 16. The presence of xylanase is clearly not solely responsible for the differences between the Washer 25 and BHD pulps.

EXAMPLE 5

Correlation Of Bleached Brightness With Kappa Number

Figure 9:
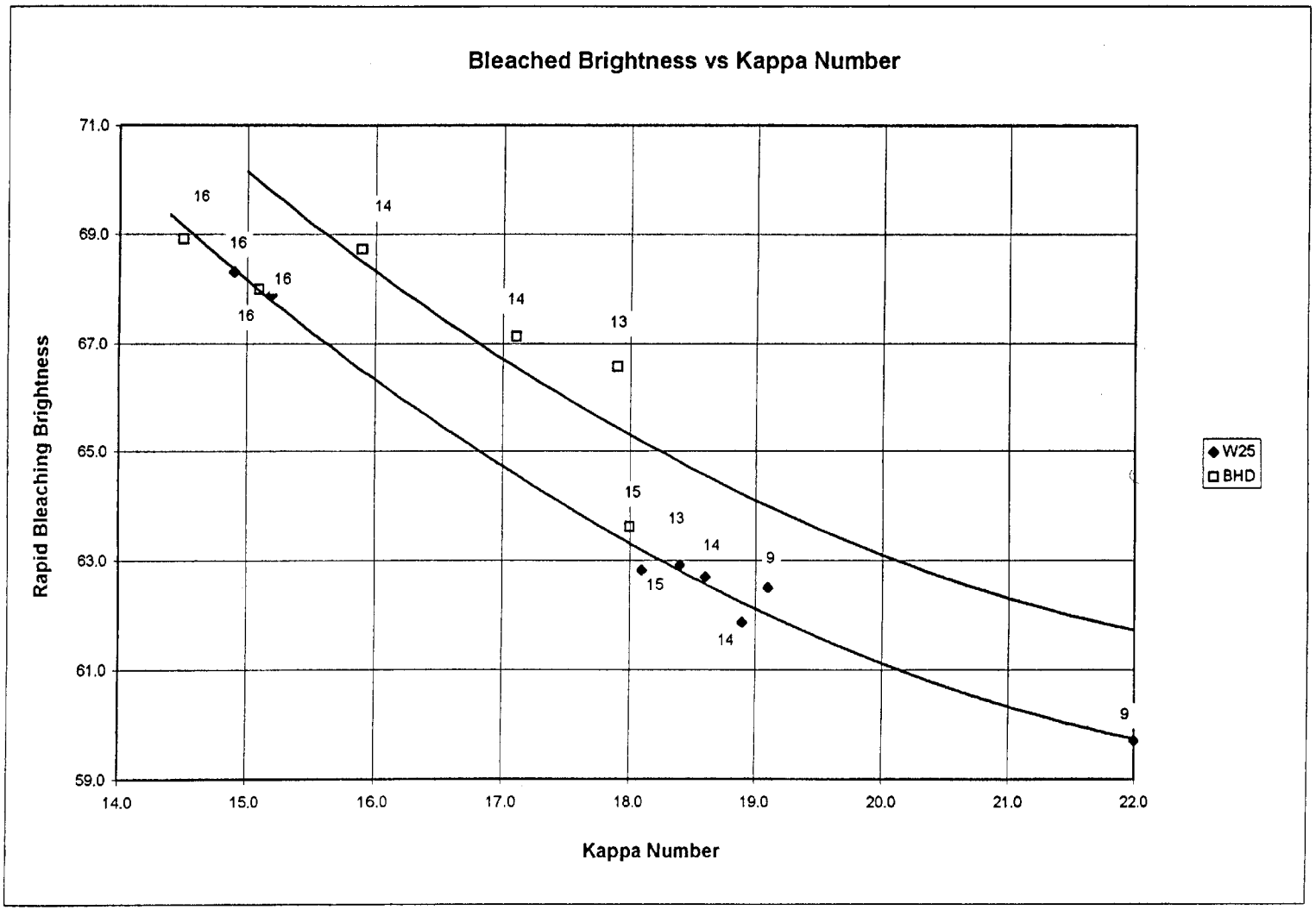
FIG. 9 is a plot of the bleached brightness of the pulps as a function of the Kappa number.

The Kappa number of the samples of Example 3 was measured manually using the chemical procedures of TAPPI T-236 before the samples were bleached. The results are shown in FIG. 9, where they are compared with the bleached brightness. The labels beside the data points indicate the day the samples were taken.

On first impression, the data shows the expected trends. The bleached brightness decreases with increasing Kappa number. The data representing the BHD pulps lie along the curve 2 points higher than the Washer 25 pulps, which is consistent with the expected effect of xylanase enzyme treatment, from Example 4.

Upon further reflection, there are inconsistencies apparent in FIG. 9. The BHD data are at a higher brightness than the Washer 25 data on January 13 and 14, but not January 15 and 16. Based on this data, it is still unclear as to why the discrepancy is seen among the days indicated. This discrepancy is explained in Example 6.

EXAMPLE 6

Measurement Of Lignin Content By The Optical Device

Figure 10:
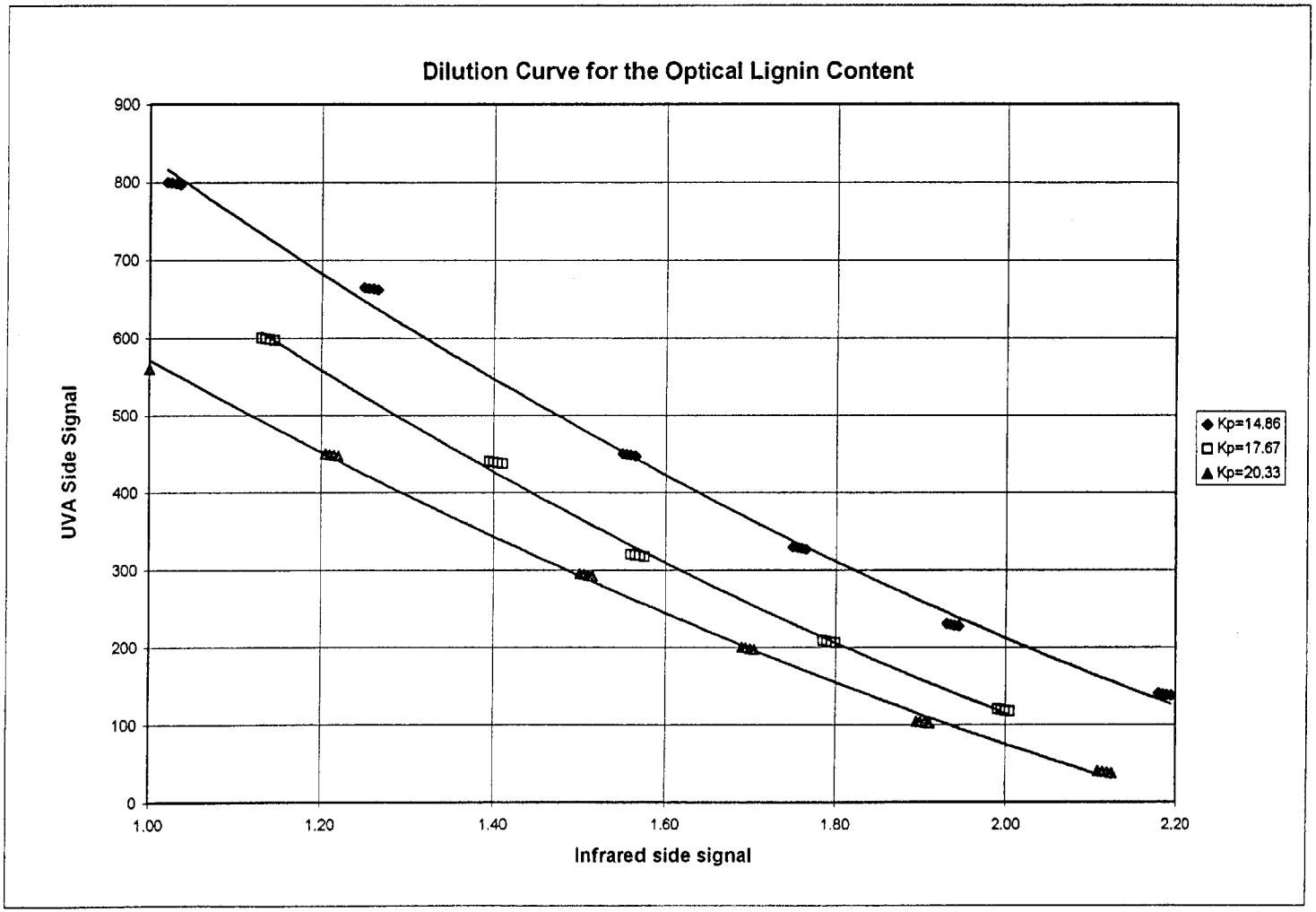
FIG. 10 is a plot of the calibration measurement for lignin content.

Three samples of unbleached softwood Kraft pulp were used to calibrate the optical lignin measurements in this example. The samples were placed in the bleaching chamber and the pulp absorbance and the ratio of UVA side reflectance to infrared side reflectance was measured using detectors 30 and 32 in FIG. 4. The pulp was then continuously diluted with water and the readings continued. The results are shown in FIG. 10. A different curve is obtained for each pulp, with the positions of the curves corresponding in the order of the Kappa numbers of the pulp.

This data was fit to the following third-order polynomial in absorbance (Equation 5):

$$\text{UVAside/IRside}=B00+B01*Kp+B10*B11*Kp*ABS+B20+B21*Kp*ABS^2+(B30+B31*Kp)*ABS^3 \quad (5)$$

where Kp=Lignin content value

The Bxy constants are determined based on the data present. For this example, the calibration constants were:

B00=448.77
B10=221.21
B20=−2733.92
B30=572.20
B01=17.07
B11=−143.45
B21=98.03
B31=18.12

Solving Equation (5) for the Kappa number results in Equation (6):

$$L=\frac{(UVAside/IRside)-(B_{00}+B_{10}*\text{ABS}+B_{20}*\text{ABS}^2+B_{30}*\text{ABS}^3)}{(B_{01}+B_{11}*\text{ABS}+B_{21}*\text{ABS}^2+B_{31}*\text{ABS}^3)} \quad (6)$$

where L=optical lignin content, which is the apparent Kappa number based on the optical measurements.

Figure 11:
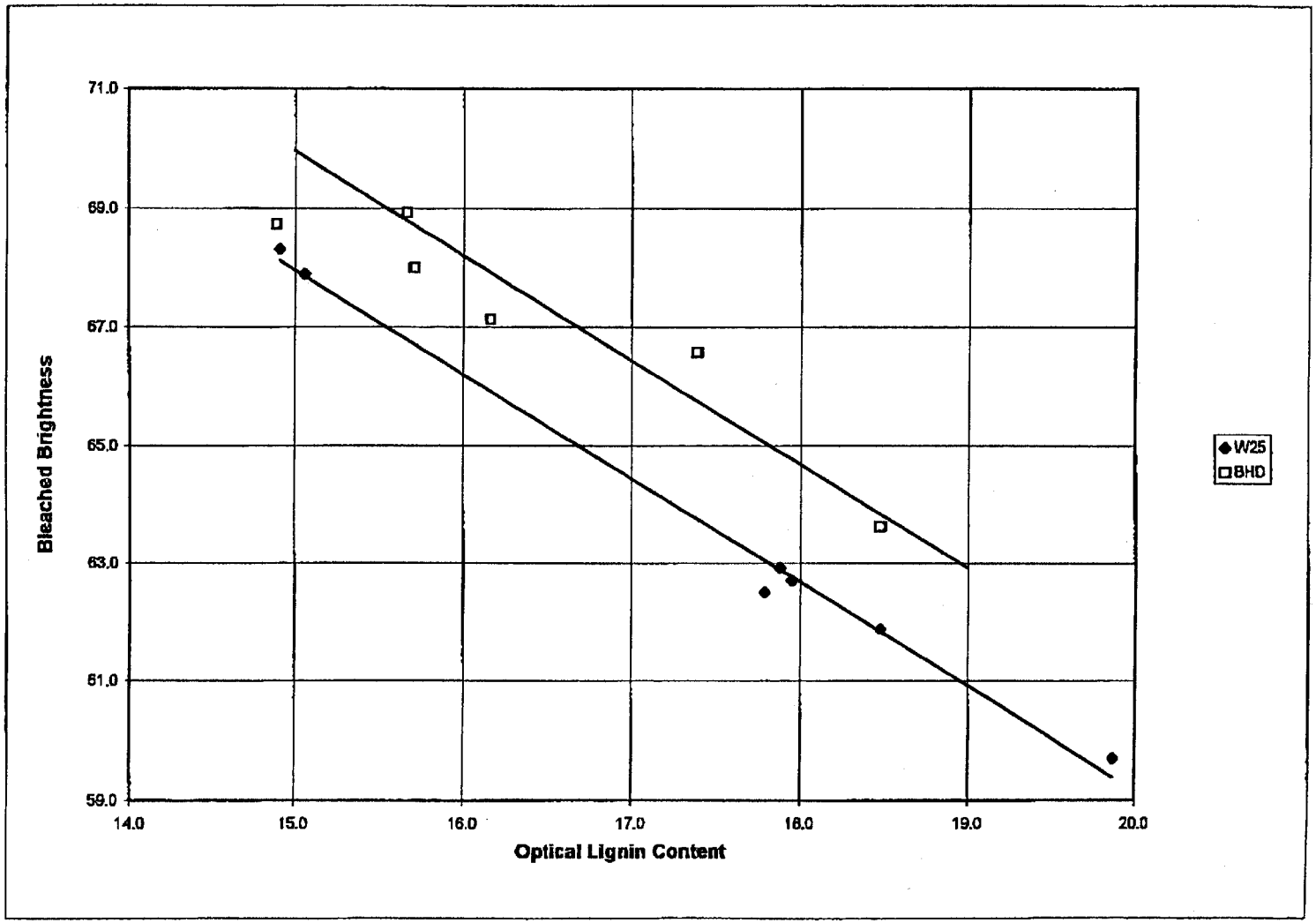
FIG. 11 is a plot of the bleached brightness of the pulps as a function of the optical lignin content.

Using these procedures, the lignin content of the samples from Example 3 was measured. These results were correlated with the bleached brightness of the pulps from Example 3. The results are shown in FIG. 11.

The bleached brightness is inversely proportional to the lignin content of the pulp. In addition, all of the data representing the BHD pulp lies on a line about two units higher than the Washer 25 pulp. This result is consistent with the increased brightness one might expect from xylanase enzyme treatment. We therefore conclude that the xylanase enzyme delivered about two points of benefit consistently throughout the test period.

The hemicellulase enzyme effectiveness was therefore a brightness increase of 2 points.

The optical measure of lignin content is superior to the Kappa number measurement in terms of the information conveyed. The bleached brightness is directly proportional to the optical lignin content, whereas the relationship between Kappa number and pulp brightness is nonlinear. In addition, the optical lignin content is effective in characterizing the effect of the xylanase enzymes, while the chemical Kappa number correlates with the bleached brightness only a portion of the time.

EXAMPLE 7

Effectiveness Of Hemicellulase Enzyme Treatment

The effect of the xylanase enzyme treatment is determined by comparing the data representing BHD pulp in FIG. 11 with that of Washer 25 pulp. The degree to which the higher brightness of the bleached BHD pulp is due to enzyme treatment can be expressed as a reduction in the effective lignin content. This is done by observing the lignin content of enzyme-treated BHD pulp that results in the same bleached brightness as untreated Washer 25 pulp.

Figure 12:
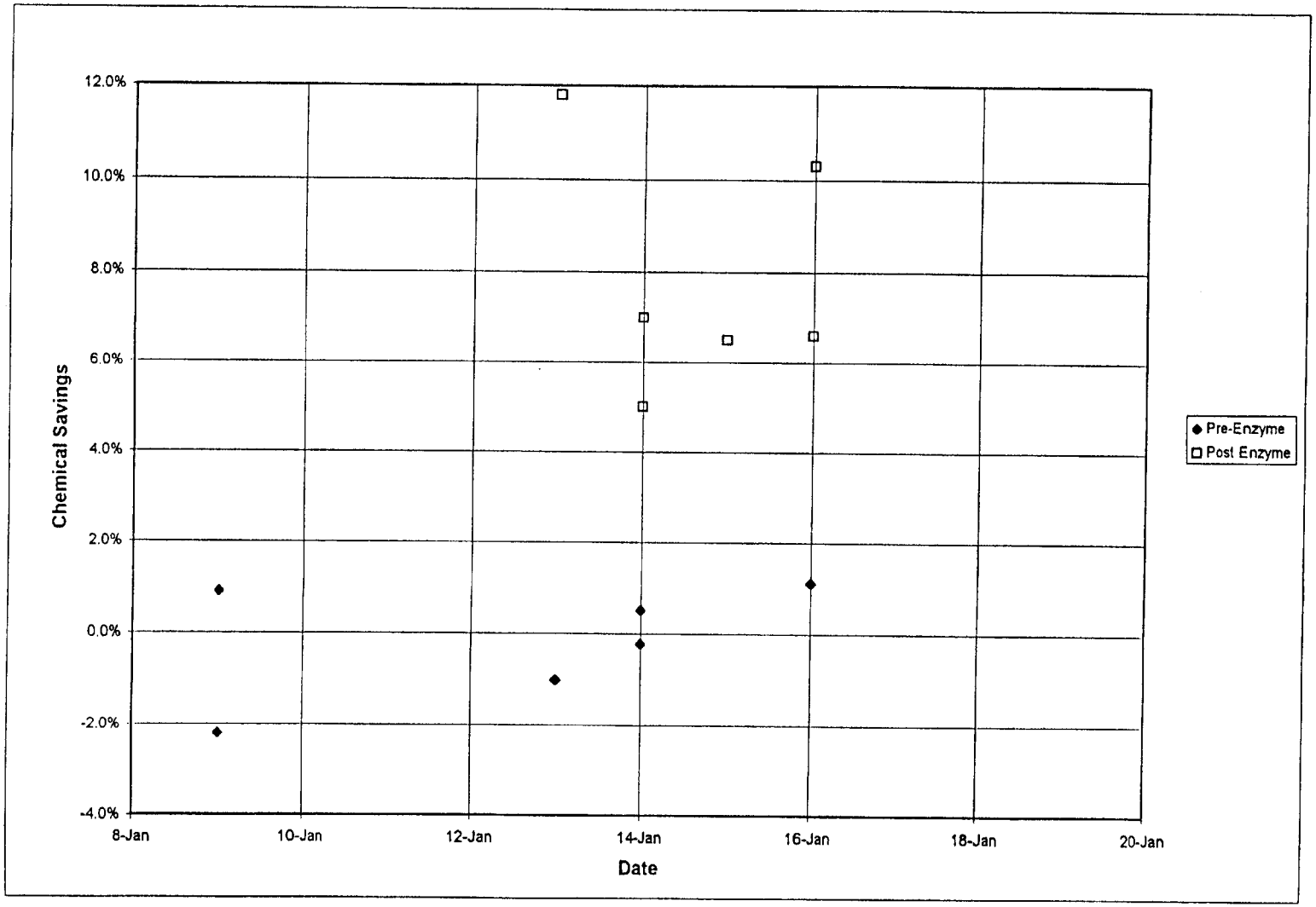
FIG. 12 is a plot showing the chemical savings due to enzyme treatment over several days.

The results are shown in FIG. 12.

In terms of hemicellulase enzyme effectiveness, the enzyme-treated BHD pulp required 5% to 10% less bleaching chemical than the untreated Washer 25 pulp throughout the trial period.

EXAMPLE 8

Treatment Of Brownstock Pulp With Hemicellulase Enzymes

Brownstock Kraft pulp was obtained from a mill in western Canada. The pulp was softwood, Kappa number 34.5. The pulp was washed thoroughly with water and pressed to a consistency of 28%. Samples of 10 grams of pulp (dry basis) were placed in heat-sealable plastic bags and topped up to a total of 100 grams with water. The pulp was adjusted to pH 6 with IN sulfuric acid, with the bags incubated at 50 C for 15 minutes to allow the pH to equilibrate. At this time, the bags were squeezed to allow about 30 grams of filtrate to sit separately from the pulp.

The hemicellulase enzyme was added to the filtrate. The enzyme consisted of Iogen GS35, a commercial xylanase enzyme preparation available from logen Corporation. The enzyme is standardized to a concentration of 3500 xylanase units per milliliter.

The enzyme was added to the filtrate at concentrations corresponding to 0 to 1000 ml per tonne pulp. To facilitate enzyme addition, the GS35 was diluted in pH 5 citrate buffer to 1/100 of its initial strength. The enzyme was mixed in the filtrate, then the filtrate was kneaded into the pulp for one minute to obtain even dispersion of the enzyme into the pulp. The pulp bags were then sealed and incubated in a 50 C water bath for one hour.

At the end of this period, a small volume of the pulp filtrate was squeezed out of the bag. The pulp was then diluted with 100 ml of 4 C water and acidified with 0.3 ml of 10% hydrochloric acid, which destroyed the residual enzyme activity. The pulp samples were then ready for processing in the rapid bleaching chamber, as described in Example 3.

The small amount of pulp fines were removed from the filtrate sample by filtering across glass microfiber filter paper. The xylose concentration in the filtrate was determined by dilute acid hydrolysis, to convert the xylose oligomers to the monomer, and then analyzing for xylose using an HPLC. The dilute acid hydrolysis was carried out by adding 1 ml of 4% (w/w) sulfuric acid to 1 ml filtrate and autoclaving at 121 C for 1 hour. After cooling, the samples were diluted 1:20 in deionized water and injected into a Dionex Pulse-Amperometric HPLC to determine the xylose concentration. The xylose concentration in the filtrate was related to the amount of pulp present to obtain the mg of xylose released per gram of pulp.

Figure 13:
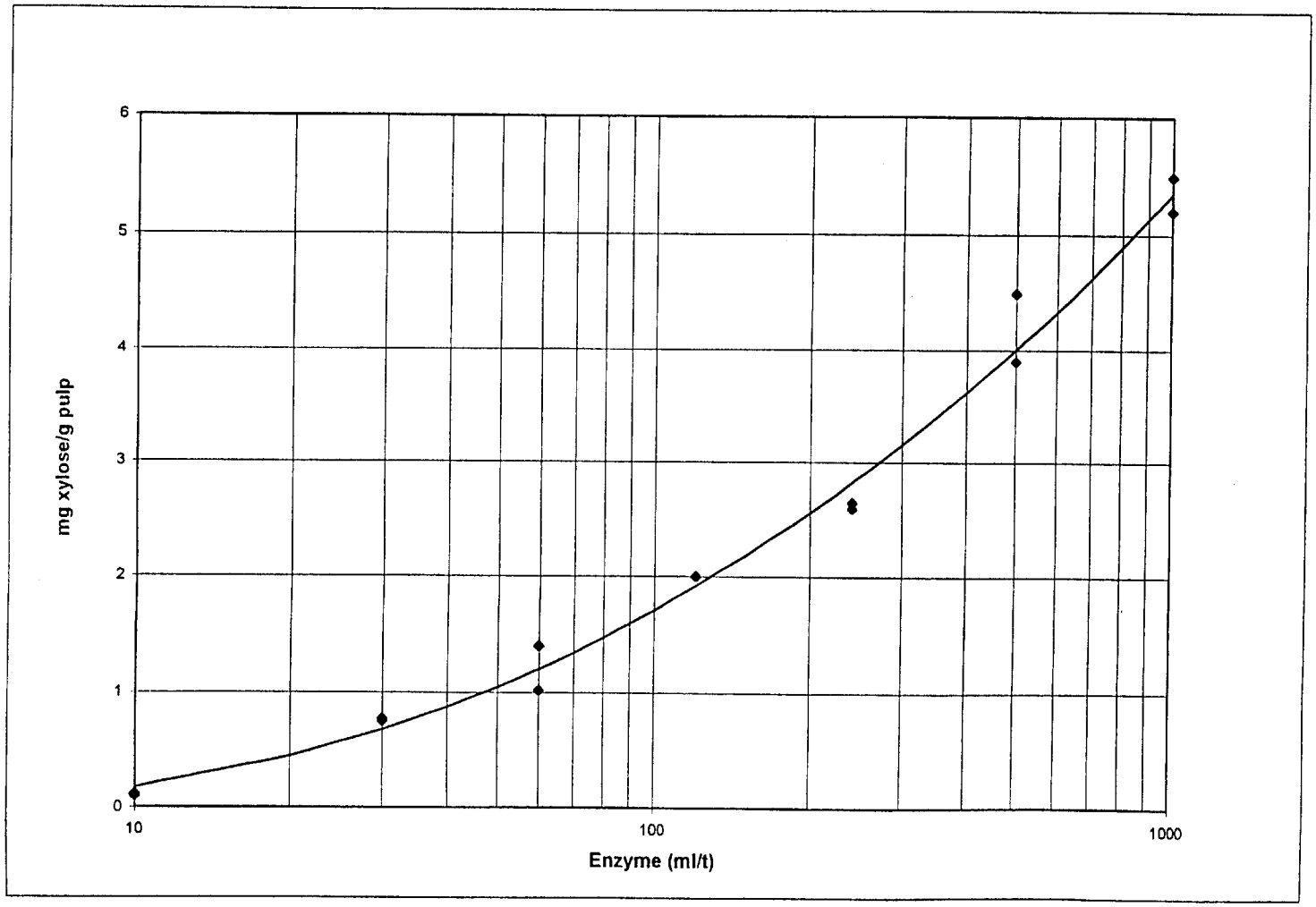
FIG. 13 is a plot of the effect of enzyme treatment on the amount of xylose released from pulp.

The results are shown in FIG. 13. The amount of xylose released by the hemicellulase enzyme increases with increasing enzyme dosage, as one expects.

EXAMPLE 9

Assessment Of Extent Of Enzyme Treatment By Rapid Bleaching

For Example 9, the 10 gram pulp samples from Example 8 were processed using the rapid bleaching device as described in Example 2, except the following chemical loadings were used in bleaching the pulp:

| Stage | Chemical | % on pulp |
|---|---|---|
| D | Sodium chlorite | 20 |
| | Sulfuric acid | 47 |
| E1 | Sodium hydroxide | 75 |
| A1 | Sulfuric acid | 120 |
| E2 | Sodium hydroxide | 75 |
| A2 | Sulfuric acid | 120 |

Figure 14:
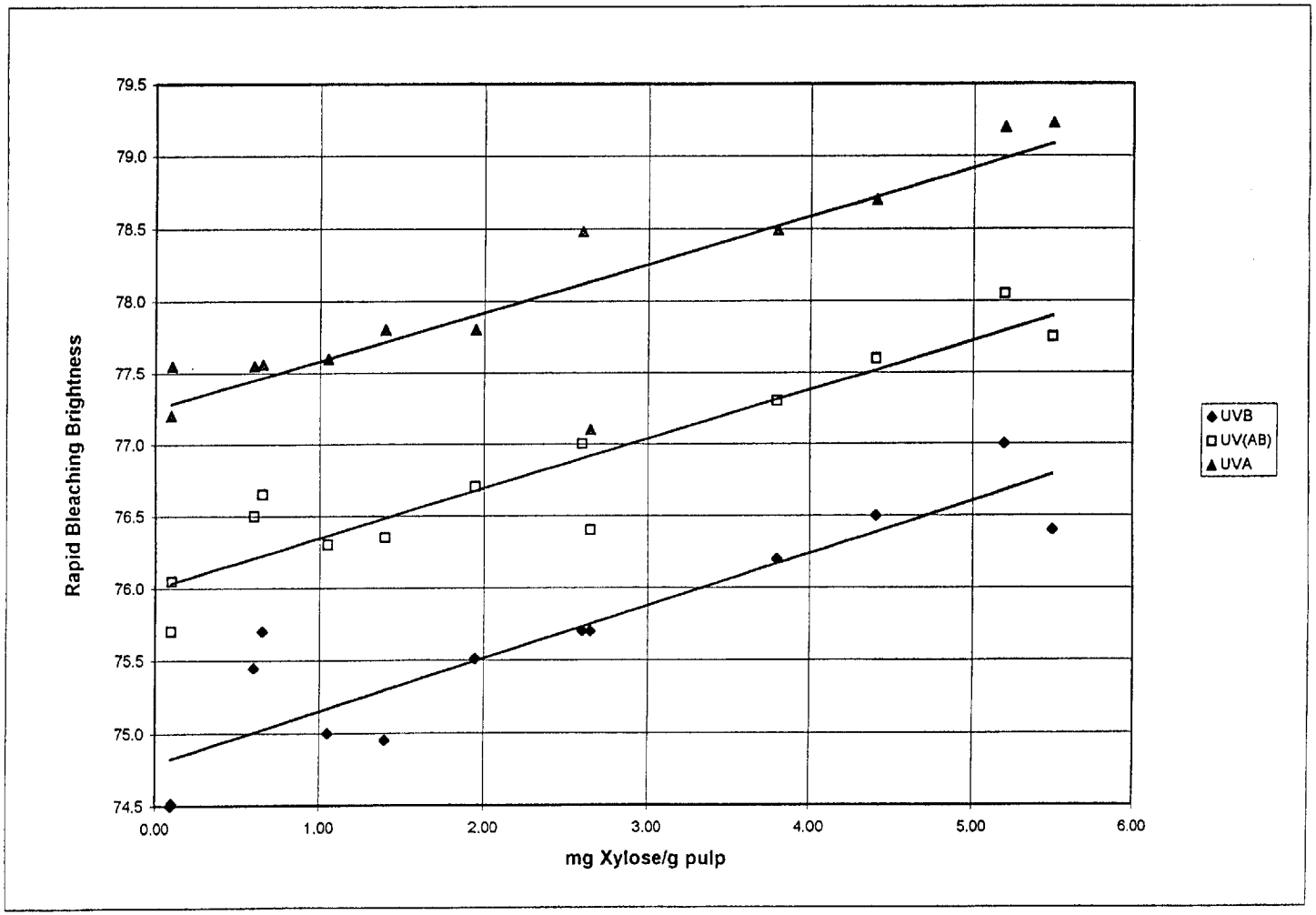
FIG. 14 is a plot of the bleached brightness of pulp as a function of the amount of xylose released.

The results for the several pulps of Example 8 are shown in FIG. 14. The rapid bleaching brightness increases linearly with the amount of xylose released by enzyme treatment. This indicates that the rapid bleaching shows the extent of effectiveness of the enzyme treatment.

The brightnesses achieved in this example are 75 to 79 ISO. We have found that brightnesses above about 56 ISO provide the best differentiation between enzyme treated and untreated pulp.

EXAMPLE 10

Rapid Bleaching Of A Variety Of Pulps

This example demonstrates the applicability of the rapid bleaching device to a variety of pulps.

Four mills were used as sources of 27 pulp samples for this study.

1. A softwood Kraft pulp mill in western Canada. This mill has oxygen delignification. A total of ten pulp samples of Kappa number between 14 and 22 were used.
2. A second softwood Kraft pulp mill in western Canada, also with oxygen delignification. A total of 6 pulps of Kappa number 13 to 25 were used.
3. A softwood Kraft pulp mill in western Canada, but without oxygen delignification. A total of four pulps of Kappa number 24 to 34 were tested.
4. A hardwood Kraft pulp mill from the northern United States. A total of 7 pulps of Kappa number 10 to 12 were tested.

The amount of chemical applied and range of TKf for the pulps is indicated in the following table:

| Mill | Pulp | Kappa # | Na Chlorite (% on pulp) | TKf |
|---|---|---|---|---|
| 1 | Softwood, $O_2$ delignification | 14.5–22 | 5.83 | 0.7–1.06 |
| 2 | Softwood, $O_2$ delignification | 13.5–25.1 | 5.84 | 0.61–1.14 |
| 3 | Softwood | 24.7–33.8 | 9.85 | 0.77–1.05 |
| 4 | Hardwood | 10.6–12.3 | 0.49 | 0.10–0.12 |

Figure 15:
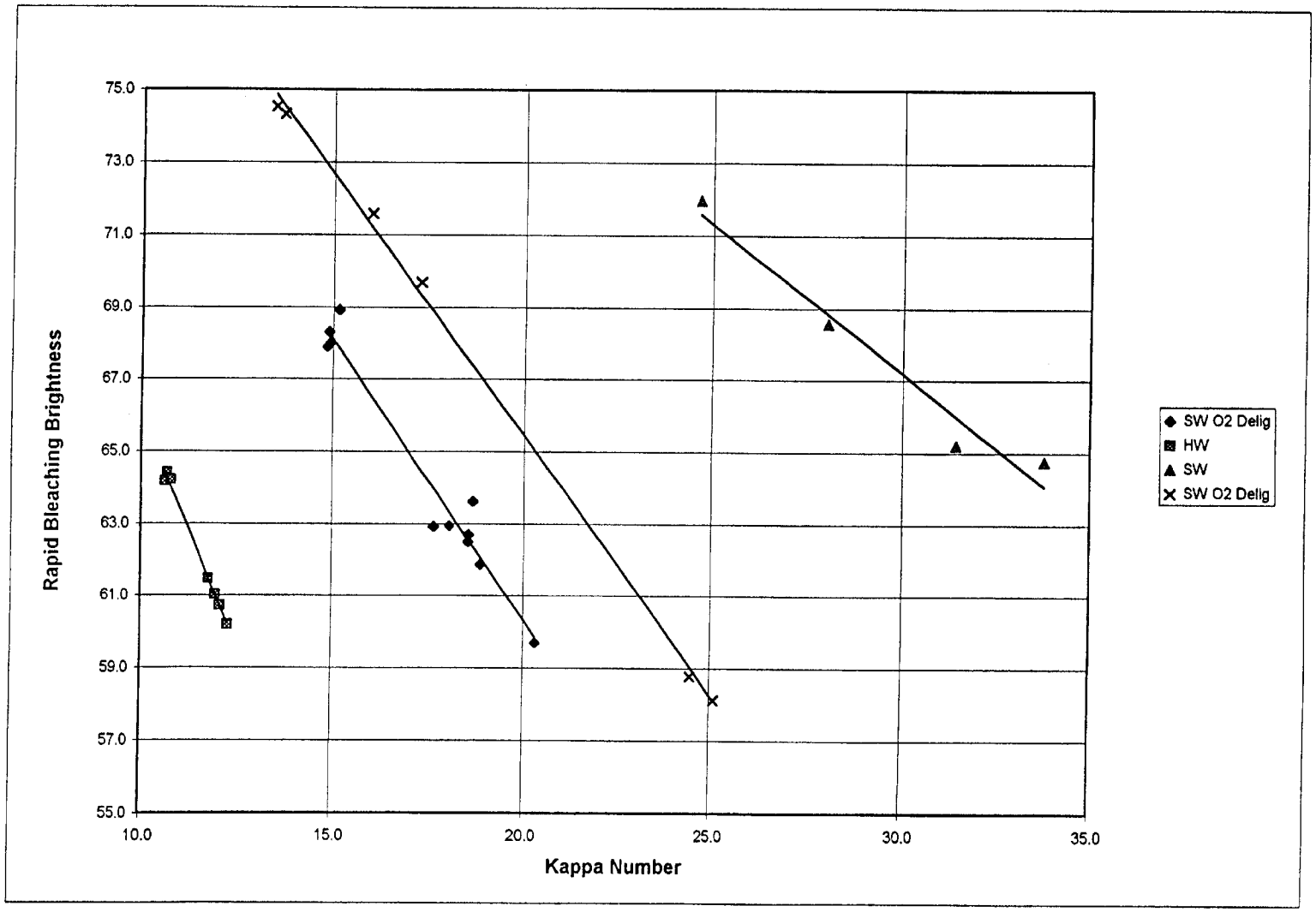
FIG. 15 is a plot of the bleached brightness of pulp from four different mills as a function of the Kappa number.

The pulps were rapidly bleached and the bleached brightness was measured, as described in Example 2. The results are shown in FIG. 15.

For all four mills, the data falls on straight lines. The correlation would be even better with an optical lignin measurement. However, the data indicates that the device will be useful over a wide range of pulps.

While the present invention has been described with respect to what is at present ed to be the preferred embodiments, it is to be understood that the invention is ted to the disclosed embodiments. To the contrary, the invention is intended to rious modifications and equivalent arrangements included within the spirit and the appended claims. The scope of the following claims is to be accorded the interpretation so as to encompass all such modifications and equivalent functions.

We claim:

1. A method for determining the bleach requirement and bleachability of pulp, said method comprising:

i) providing a pulp sample obtained from a pulp stock into an off-line reaction chamber;

ii) controlling the amount of the pulp sample in the off-line reaction chamber;

iii) conducting one or more first optical measurement of the pulp sample;

iv) adding at least one chemical to the pulp sample in the off-line reaction chamber in a controlled manner by:

a) adding at least one compound to create a bleaching medium;

b) deactivating the bleaching medium by adding at least one alkaline compound, and maintaining the bleaching medium at an alkaline pH level in the reaction chamber;

c) reactivating the bleaching medium by adding at least one acid compound, and maintaining the bleaching medium at an acidic pH level in the reaction chamber;

v) conducting one or more second optical measurement;

vi) processing the first, second, or both the first and the second optical measurement to determine the bleach requirement and bleachability of the pulp sample; and vii) from said bleach requirement and bleachability determined in step vi) extrapolating an amount of chemical required to fully bleach the pulp stock, said method carried out prior to adding bleach to the pulp stock, and said method conducted in less than about 60 min.

2. The method of claim 1, wherein said processing of the optical measurements to calculate an optical lignin content of the pulp sample is conducted before step iv.

3. The method of claim 2, wherein said processing of the optical measurements to calculate an optical lignin content of the pulp sample is conducted after step iv.

4. The method of claim 1, wherein said conducting step includes conducting infrared absorbance measurements of the pulp sample.

5. The method of claim 1, wherein said conducting step includes conducting ultraviolet and near infrared reflectance measurements of the pulp sample.

6. The method of claim 1 wherein step iv) a) comprises adding at least one compound for bleaching the pulp sample selected from the group consisting of chlorine, chlorine dioxide, hypochlorous acid, sodium hydrosulfite, potassium permanganate, ozone, nitrous acid, and peracetic acid.

7. The method of claim 1 wherein step iv a). comprises adding sodium chlorite and an acid for bleaching the pulp sample.

8. The method of claim 1 wherein step iv) a) comprises adding sodium chlorite and sulfuric acid for bleaching the pulp sample.

9. The method of claim 1 wherein step iv) a) comprises adding sodium chlorite and an acid selected from the group consisting of sulfuric acid, sulfurous acid, hydrochloric acid, phosphoric acid, and nitric acid.

10. The method of claim 1 wherein step iv) b) comprises adding at least sodium hydroxide in an effective amount to deactivate the bleaching medium and maintain the bleaching medium at an alkaline pH level in the reaction chamber.

11. The method of claim 1 wherein step iv) b) comprises adding at least one alkaline compound selected from the group consisting of sodium hydroxide, potassium hydroxide, sodium carbonate, ammonia, and ammonium hydroxide, in an effective amount to deactivate the bleaching medium and maintain the bleaching medium at an alkaline pH level in the reaction chamber.

12. The method of claim 1 wherein step iv) c) comprises adding sulfuric acid in an effective amount to reactivate the bleaching medium and maintain the bleaching medium at an acidic pH level in the reaction chamber.

13. The method of claim 1 wherein step iv) c) comprises adding at least one acid compound selected from the group consisting of sulfuric acid, sulfurous acid, hydrochloric acid, phosphoric acid, and nitric acid, in an effective amount to reactivate the bleaching medium and maintain the bleaching medium at an acidic pH level in the reaction chamber.

14. The method of claim 1, wherein said providing step comprises providing between about 1 and about 3000 grams dry weight of the pulp sample into the reaction chamber.

15. The method of claim 1, wherein said providing step comprises providing between about 1 and about 100 grams dry weight of the pulp sample into the reaction chamber.

16. The method of claim 1, wherein said providing step comprises providing the pulp sample from an automatic sampling unit.

17. The method of claim 1, wherein said controlling step includes using a consistency controller to control the amount of the pulp sample in the reaction chamber.

18. The method of claim 1, wherein said bleaching step results in the pulp sample having a brightness level of at least about 56 ISO.

19. The method of claim 1 wherein said method is used to determine the effectiveness of hemicellulase enzyme treatment of said pulp sample, said method further comprising:

i) determining the bleach requirement, and bleachability of at least two pulp samples, one of said pulp samples being treated with said hemicellulase prior to determining the bleach requirement and bleachability; and ii) comparing the bleach requirement, bleachability, the amount of chemical required to bleach the pulp stock, or a combination thereof, for each of said at least two pulp samples.

20. The method of claim 1 wherein step iv) a) comprises adding at least one compound for bleaching the pulp sample selected from the group consisting of hydrogen peroxide, sodium hypochlorite, and oxygen.

21. A method for determining a rapid bleaching brightness of a pulp, said method comprising:

i) providing a pulp sample into an off-line reaction chamber;

ii) controlling the amount of the pulp sample in the off-line reaction chamber;

iii) conducting a first optical measurement of the pulp sample in the off-line reaction chamber;

iv) adding at least one chemical to the pulp sample in the off-line reaction chamber in a controlled manner by;

a) adding at least one compound to create a bleaching medium;

b) deactivating the bleaching medium by adding at least one alkaline compound, and maintaining the bleaching medium at an alkaline pH level in the reaction chamber;

c) reactivating the bleaching medium by adding at least one acid compound, and maintaining the bleaching medium at an acidic pH level in the reaction chamber;

v) conducting a second optical measurement; and vi) processing the first and second optical measurements and calculating from the processed optical measurements a rapid bleaching brightness of the pulp sample, wherein said method is conducted in less than about 60 minutes.

22. The method of claim 21, wherein said conducting step includes conducting infrared absorbance measurements of the pulp sample.

23. The method of claim 21, wherein said conducting step includes conducting ultraviolet and near infrared reflectance measurements of the pulp sample.

24. A method for determining the bleach requirement, and bleachability of pulp, said method comprising:

i) providing a pulp sample into an off line reaction chamber;

ii) controlling the amount of the pulp sample in the off-line reaction chamber;

iii) conducting optical measurements of the pulp sample;

iv) bleaching the pulp sample in the off-line reaction chamber in a controlled manner by:

a) adding at least one compound to create a bleaching medium;

b) deactivating the bleaching medium by adding at least one alkaline compound, and maintaining the bleaching medium at an alkaline pH level in the reaction chamber;

c) reactivating the bleaching medium by adding at least one acid compound, and maintaining the bleaching medium at an acidic pH level in the reaction chamber;

v) washing the pulp sample in the off-line reaction chamber;

vi) processing the optical measurements to calculate an optical lignin content and rapid bleaching brightness of the pulp sample; and vii) using the optical lignin content and rapid bleaching brightness to determine the bleach requirement and bleachability, of the pulp sample, wherein said method is conducted in less than about 60 min.

25. The method of claim 24 wherein the pulp sample is washed prior to conducting the first, second, or both the first and second optical measurement.

26. The method of claim 24, wherein said bleaching medium, in each of steps a), b), and c) is maintained from about 10 sec, to about 5 minutes.

27. The method of claim 24, wherein steps a) and b) are repeated at least once.

28. A method for determining the bleach requirement and bleachability of pulp, said method comprising:

i) providing a pulp sample obtained from a pulp stock into an off-line reaction chamber;

ii) controlling the amount of the pulp sample in the off-line reaction chamber;

iii) conducting one or more first optical measurement of the pulp sample in the off-line reaction chamber;

iv) adding at least one chemical to the pulp sample in the off-line reaction chamber in a controlled manner by;

a) adding at least one compound to create a bleaching medium;

b) deactivating the bleaching medium by adding at least one acid compound, and maintaining the bleaching medium at an acidic pH level in the reaction chamber;

c) reactivating the bleaching medium by adding at least one alkaline compound, and maintaining the bleaching medium at an alkaline pH level in the reaction chamber;

v) conducting one or more second optical measurement in the off-line reaction chamber;

vi) processing the first, second, or both the first and the second optical measurement to determine the bleach requirement and bleachability of the pulp sample; and vii) from said bleach requirement and bleachability determined in step vi) extrapolating an amount of chemical required to fully bleach the pulp stock, said method carried out prior to adding bleach to the pulp stock, and said method conducted in less than about 60 min.

* * * * *